US008931868B2

(12) United States Patent
Fukuda et al.

(10) Patent No.: US 8,931,868 B2
(45) Date of Patent: Jan. 13, 2015

(54) INK JET RECORDING APPARATUS

(71) Applicant: Seiko Epson Corporation, Tokyo (JP)

(72) Inventors: Masako Fukuda, Shiojiri (JP); Tomohiro Sayama, Matsumoto (JP); Shoki Kasahara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/193,381

(22) Filed: Feb. 28, 2014

(65) Prior Publication Data

US 2014/0247305 A1 Sep. 4, 2014

(30) Foreign Application Priority Data

Mar. 1, 2013 (JP) ..... 2013-040406

(51) Int. Cl.

| | |
|---|---|
| ***B41J 2/21*** | (2006.01) |
| ***B41J 29/38*** | (2006.01) |
| ***B41J 2/195*** | (2006.01) |
| ***B41J 2/135*** | (2006.01) |
| ***B41J 2/17*** | (2006.01) |
| ***B41J 2/165*** | (2006.01) |

(52) U.S. Cl.

CPC ..... *B41J 2/16535* (2013.01); *B41J 2002/1655* (2013.01)

USPC ..... 347/7; 347/6; 347/33; 347/43; 347/95; 347/44

(58) Field of Classification Search

USPC ..... 347/6–7, 43–44, 84–85, 95, 33

See application file for complete search history.

(56) References Cited

U.S. PATENT DOCUMENTS

| | | | | |
|---|---|---|---|---|
| 7,090,728 | B2 * | 8/2006 | Nakamura | 134/6 |
| 7,210,763 | B2 | 5/2007 | Kato et al | |
| 7,264,329 | B2 | 9/2007 | Kato et al. | |
| 7,673,964 | B2 | 3/2010 | Furukawa | |
| 7,695,099 | B2 | 4/2010 | Sanada et al. | |
| 2012/0327156 | A1 * | 12/2012 | Aruga et al. | 347/20 |
| 2014/0152739 | A1 | 6/2014 | Fukuda et al. | |
| 2014/0152741 | A1 | 6/2014 | Nakane et al. | |
| 2014/0152742 | A1 | 6/2014 | Mizutani et al. | |

FOREIGN PATENT DOCUMENTS

| | | | |
|---|---|---|---|
| JP | 2003-313473 | A | 11/2003 |
| JP | 2005-096212 | A | 4/2005 |
| JP | 2005-096214 | A | 4/2005 |

(Continued)

*Primary Examiner* — Jason Uhlenhake

(74) *Attorney, Agent, or Firm* — Nutter McClennen & Fish LLP

(57) ABSTRACT

An ink jet recording apparatus has a first discharge port array in which discharge ports of a plurality of nozzles which discharge an ink composition containing an inorganic pigment are disposed side by side, a second discharge port array in which discharge ports of a plurality of nozzles which discharge an ink composition containing a coloring material other than the inorganic pigment are disposed side by side, a nozzle plate having the first discharge port array and the second discharge port array, a liquid repellent film provided on the nozzle plate, a wiping member which wipes the surface of the nozzle plate and has absorbability of the ink composition, in which, in a series of operations in which the surface of the nozzle plate is wiped by the wiping member, the second discharge port array is wiped in priority to the first discharge port array.

8 Claims, 6 Drawing Sheets

(56) References Cited

FOREIGN PATENT DOCUMENTS

| | | | |
|---|---|---|---|
| JP | 2006-142804 | A | 6/2006 |
| JP | 2006-205713 | A | 8/2006 |
| JP | 2008-229962 | A | 10/2008 |
| JP | 2009-101630 | A | 5/2009 |
| JP | 4424954 | B2 | 3/2010 |
| JP | 2014-108523 | A | 6/2014 |

* cited by examiner

INK JET RECORDING APPARATUS

Priority is claimed under 35 U.S.C. §119 to Japanese Application No. 2013-040406 filed on Mar. 1, 2013, is hereby incorporated by reference in its entirety.

BACKGROUND

1. Technical Field

The present invention relates to an ink jet recording apparatus.

2. Related Art

Recording employing an ink jet recording system is performed by discharging small ink droplets and causing the small ink droplets to fly to cause the small ink droplets to adhere onto recording media, such as paper. Due to a recent innovative progress of the ink jet recording technology, an ink jet recording apparatus employing the ink jet recording system has been used also in the field of high definition image recording for which photo and offset printing have been used until now.

In the ink jet recording apparatus, when moisture and other volatile components contained in ink to be discharged evaporate, the viscosity of the ink increases. In recent ink jet recording, in order to perform high definition recording, the amount of ink droplets to be discharged is a very slight, e.g., several pico liters, the diameter of nozzles which discharge ink is small, and the energy required for discharging the ink droplets is also small. Since the nozzle diameter is small and the discharge energy is also small, the ink which adheres to the nozzles and undergoes an increase in viscosity cannot be eliminated, so that clogging of the nozzles is likely to occur, which sometimes results in poor ink discharge. Furthermore, fibers, paper powder, surrounding dust, and the like generated from recording media, such as paper and cloth, sometimes adhere to the formation surface (nozzle plate surface) of nozzles, which similarly hinders normal discharge of ink.

In order to prevent or reduce the poor discharge caused by the increase of in viscosity of ink and the adhesion of foreign substances to the surface of the nozzle plate described above, an ink jet recording apparatus having a wiper mechanism (recovery mechanism) has been proposed. For example, JP-A-2006-142804 discloses an ink jet recording apparatus having a cleaning mechanism employing a wiping blade. JP-A-2006-142804 discloses a technique of reducing the coefficient of friction of the wiping blade and a head (nozzle plate surface) and disposing fine particles on the surface of the wiping blade in such a manner as to protect the surface of the nozzle plate. JP-A-2009-101630 discloses, as an ink jet recording apparatus capable of simultaneously achieving low cost, high weatherability, high durability, and high reliability, an ink jet recording apparatus which has an application unit for applying a treatment liquid to a recording head or a wiping member and which carries out wiping as required, e.g., when it is judged that the head face surface (nozzle plate surface) dries.

However, the method according to JP-A-2006-142804 has had a problem in that the ink wiping properties are poor. Specifically, the method has had a problem in that, in the case of the cleaning using the wiping blade, when ink adhering to the nozzle surface, a nozzle plate cover, or the wiping blade suffers from an increase in viscosity and dries, for example, the ink cannot be removed. On the other hand, the method described in JP-A-2009-101630 has had a problem in that, although the wiping properties improve, a liquid repellent film formed on the surface of the nozzle plate deteriorates. Specifically, in the case of an ink jet recording apparatus which performs recording using an ink composition containing an inorganic pigment, there has been a problem in that the inorganic pigment present between the wiping member and the surface of the nozzle plate acts on the surface of the nozzle plate to damage the liquid repellent film and the like in cleaning (in wiping). The inorganic pigment is a component which may easily damage the liquid repellent film (a molecular film of metal alkoxide having liquid repellency or the like) typified by carbon black, titanium dioxide, and the like, for example. When the liquid repellent film is damaged around an ink discharge port, ink discharge becomes unstable, which has caused a problem in that the impact position of ink droplets varies, for example.

SUMMARY

The invention has been made in order to at least partially solve the above-described problems and can be realized as the following application examples or aspects.

Application Example 1

An ink jet recording apparatus according to this application example, has a first discharge port array in which discharge ports of a plurality of nozzles which discharge an ink composition containing an inorganic pigment are disposed side by side, a second discharge port array in which discharge ports of a plurality of nozzles which discharge an ink composition containing a coloring material other than the inorganic pigment are disposed side by side, a nozzle plate having the first discharge port array and the second discharge port array, a liquid repellent film provided on the nozzle plate, a wiping member which wipes the surface of the nozzle plate and has absorbability of the ink composition, and a moving mechanism which varies the relative position of the nozzle plate and the wiping member, in which, in a series of operations in which the surface of the nozzle plate is wiped by the wiping member, the second discharge port array is wiped in priority to the first discharge port array.

According to this application example, due to the fact that the surface of the nozzle plate is wiped by the wiping member, poor discharge caused by an increase in viscosity of the ink composition and adhesion of foreign substances to the nozzle plate is prevented or reduced. Moreover, due to the fact that the second discharge port array is wiped in priority to the first discharge port array in a series of the wiping operations in which the surface of the nozzle plate is wiped by the wiping member, a state where the inorganic pigment is present between the wiping member and the surface of the nozzle plate is difficult to occur in a series of the wiping operations. When the first discharge port array is wiped, the inorganic pigment is sometimes pressed against the surface of the nozzle plate by the wiping member to rub the surface of the nozzle plate, and therefore, the surface of the nozzle plate is sometimes damaged in the vicinity of the first discharge port array. However, the second discharge port array is wiped in priority to the first discharge port array in a state where the inorganic pigment is not present or the amount thereof is small, and therefore the damages to the surface of the nozzle plate are suppressed.

Thus, according to this application example, the state where the inorganic pigment discharged from the first discharge port array and adheres to the nozzle plate damages the entire surface of the nozzle plate while being applied and spread to the second discharge port array does not occur or is difficult to occur, so that the damage degree can be reduced. As a result, since the degradation of the liquid repellent film over the entire nozzle plate is suppressed, the discharge of the ink composition can be maintained in a more stable state.

Application Example 2

In the ink jet recording apparatus according to the application example described above, the moving mechanism varies the relative position of the nozzle plate and the wiping member in such a manner that the second discharge port array is wiped in priority to the first discharge port array.

According to this application example, the moving mechanism varies the relative position of the nozzle plate and the wiping member according to the arrangement of the first discharge port array which discharges the ink composition containing an inorganic pigment and the second discharge port array which discharges the ink composition containing a coloring material other than the inorganic pigment in such a manner that the second discharge port array is wiped in priority to the first discharge port array in a series of the wiping operations. In other words, the second discharge port array is wiped in priority to the first discharge port array by the moving mechanism irrespective of the arrangement of the first discharge port array and the second discharge port array. For example, in order to achieve high speed recording of a high definition image, even in the case of a configuration in which a plurality of the first discharge port arrays are distantly disposed in such a manner as to sandwich a plurality of the second discharge port arrays or, contrarily, even in the case of a configuration in which the first discharge port arrays are sandwiched between the second discharge port arrays, the relative position of the nozzle plate and the wiping member is varied, and wiping is carried out in such a manner that the second discharge port arrays are wiped in priority to the first discharge port arrays. As a result, the same effect as that of Application Example 1 can be obtained, and the discharge of the ink composition can be maintained in a more stable state.

Thus, according to this application example, the arrangement of the arrays of the discharge ports of nozzles on the nozzle plate, i.e., the arrangement of the nozzle arrays in an ink jet head, can be arrangement in which priority is given to the accuracy, the recording speed, and the like of a recorded image without considering the wiping order. Therefore, an ink jet recording apparatus which can record a higher definition image at a high speed and which has more excellent discharge stability can be provided.

Application Example 3

In the ink jet recording apparatus according to the application example described above, the relative position of the nozzle plate and the wiping member varies in a single direction and the first discharge port array and the second discharge port array are disposed on the nozzle plate in such a manner that the second discharge port array is wiped in priority to the first discharge port array.

According to this application example, in the wiping operation in which the relative position of the nozzle plate and the wiping member varies in a single direction, the first discharge port array and the second discharge port array are disposed in such a manner that the second discharge port array is wiped in priority to the first discharge port array. Since the same effect as that of Application Example 1 can be obtained by the simple wiping operation, the configuration of the moving mechanism can be further simplified. As a result, an ink jet recording apparatus in which the discharge of the ink composition is more stable can be provided with a more simplified configuration.

Application Example 4

In the ink jet recording apparatus according to any one of the application examples described above, it is preferable that the second discharge port array is wiped first.

As in this application example, by configuring the ink jet recording apparatus in such a manner that the second discharge port array is wiped first in a series of the wiping operations in which the surface of the nozzle plate is wiped by the wiping member, the second discharge port array which is to be wiped first is wiped in a state where the inorganic pigment is not present, and therefore damages to the surface of the nozzle plate are suppressed.

Thus, according to this application example, the degree of the damages to the entire surface of the nozzle plate caused by the inorganic pigment adhering to the nozzle plate can be reduced. As a result, since degradation of the liquid repellent film over the entire nozzle plate is suppressed, the discharge of the ink composition can be maintained in a more stable state.

Application Example 5

In the ink jet recording apparatus according to any one of the application examples described above, in the case where when the number of the first discharge port arrays is set to n and the number of the second discharge port arrays is set to m and when n+m is even, $k=(n+m)/2$ is established and when n+m is odd, $k=(n+m-1)/2$ is established, in a series of the operations in which the wiping member wipes the surface of the nozzle plate in such a manner as to wipe the first discharge port arrays or the second discharge port arrays from the first array to the n+m-th array, the percentage in which the second discharge port arrays are wiped in a range of the first array to the k-th array is larger than the percentage in which the second discharge port arrays are wiped in a range of the k+1-th array to the n+m-th array.

According to this application example, in a series of the wiping operations in which the surface of the nozzle plate is wiped by the wiping member, the percentage in which the second discharge port arrays are wiped in the first half of the sequence of the second discharge port arrays to be wiped (in a range of the first array to the k-th array) is larger than the percentage in which the second discharge port arrays are wiped in the second half of the sequence of the second discharge port arrays to be wiped (a range of the k+1-th array to the n+m-th array). Thus, due to the fact that the second discharge port arrays are wiped in priority to the first discharge port arrays, the state where the inorganic pigment is present between the wiping member and the surface of the nozzle plate is more difficult to occur in a series of the wiping operations. As a result, the state where the inorganic pigment discharged from the first discharge port array and adheres to the nozzle plate damages the entire surface of the nozzle plate while being applied and spread to the second discharge port array is more difficult to occur, so that the damage degree can be reduced.

Application Example 6

In the ink jet recording apparatus according to any one of the application examples described above, it is preferable that the average particle diameter of the inorganic pigment is 20 nm or more and 200 nm or less.

By setting the average particle diameter of the inorganic pigment contained in the ink composition to 20 nm or more and 200 nm or less as in this application example, the ink composition constituting black ink, white ink, and the like, for example, can be stably discharged as an ink jet recording apparatus. When the first discharge port array is wiped, the surface of the nozzle plate is sometimes damaged in the vicinity of the first discharge port array due to the fact that the inorganic pigment with an average particle diameter of 20 nm or more and 200 nm or less is pressed against the surface of the nozzle plate by the wiping member to rub the surface of the nozzle plate. However, damages to the surface of the nozzle plate are suppressed due to the effect described above even in the case of using such an inorganic pigment.

Application Example 7

In the ink jet recording apparatus according to any one of the application examples, it is preferable that the needle shape ratio (Maximum length/Minimum width of the particle) of the inorganic pigment is 1.5 or more and 3.0 or less.

By setting the needle shape ratio of the inorganic pigment contained in the ink composition to 1.5 or more and 3.0 or less as in this application example, an ink jet recording apparatus capable of forming an image excellent in scratch resistance, album storageability, oxidizing gas resistance, and the like can be provided. Moreover, when the first discharge port array is wiped, the surface of the nozzle plate is sometimes damaged in the vicinity of the first discharge port array due to the fact that the inorganic pigment with a needle shape ratio of 1.5 or more and 3.0 or less is pressed against the surface of the nozzle plate by the wiping member to rub the surface of the nozzle plate. However, damages to the surface of the nozzle plate are suppressed due to the effect described above even in the case of using such an inorganic pigment.

Application Example 8

In the ink jet recording apparatus according any one of the application examples described above, it is preferable that the content concentration of the inorganic pigment is 1.0% by weight or more in the ink composition containing an inorganic pigment.

Due to the fact that the content concentration of the inorganic pigment contained in the ink composition is 1.0% by weight or more as in this application example, an ink jet recording apparatus capable of forming an image having higher definition and excellent image quality, such as contrast, can be provided. Moreover, when the first discharge port array is wiped, the surface of the nozzle plate is sometimes damaged in the vicinity of the first discharge port array due to the fact that the inorganic pigment is pressed against the surface of the nozzle plate by the wiping member to rub the surface of the nozzle plate. However, damages to the surface of the nozzle plate are suppressed due to the effect described above even when 1.0% by weight or more of the inorganic pigment is contained as in this case.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments specifying the invention are described below with reference to the drawings. The following description is one embodiment of the invention and does not limit the invention. Each drawing below is sometimes drawn with a size different from the actual size for easy understanding of the description.

Figure 1:
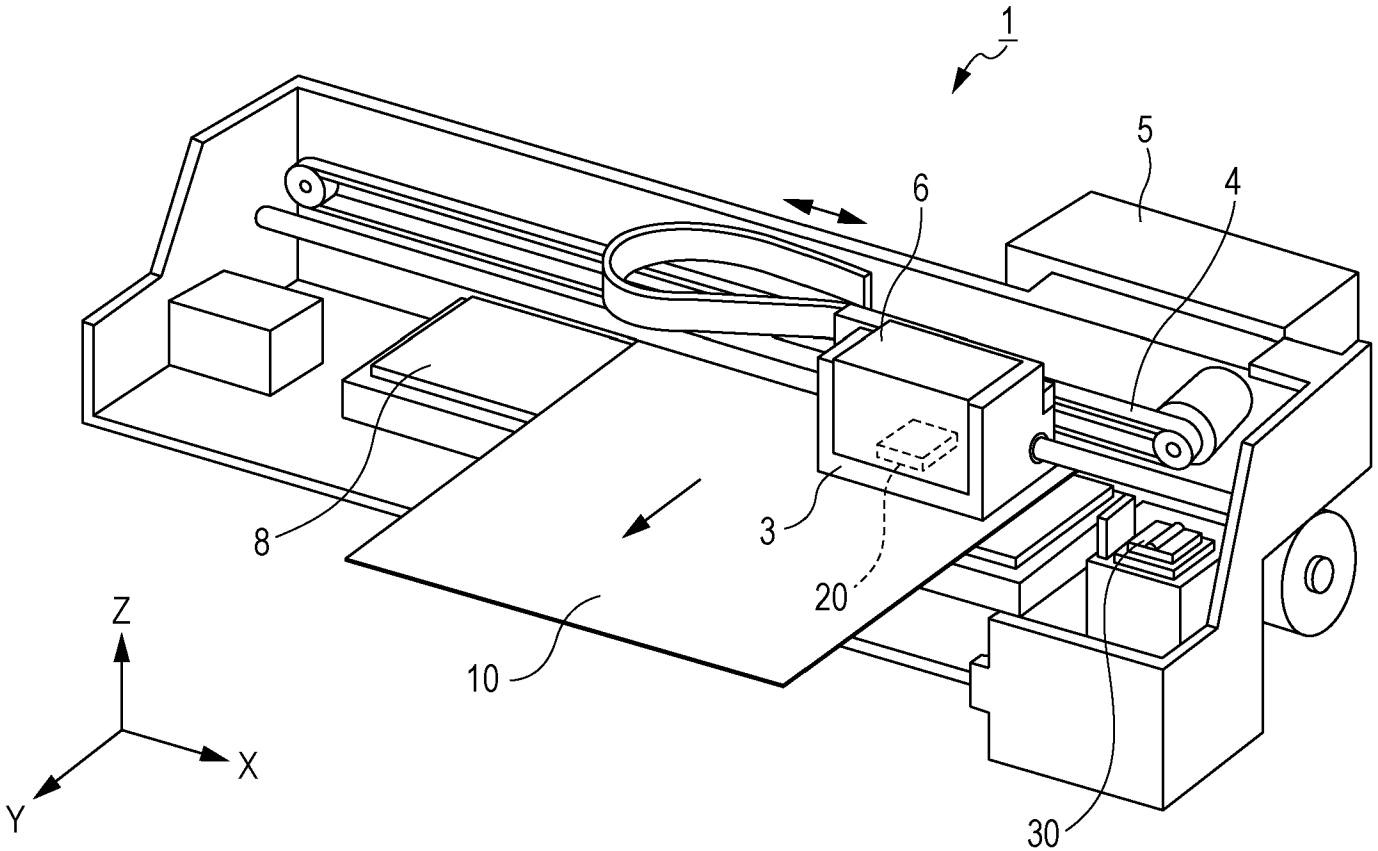
FIG. 1 is a perspective view illustrating an ink jet recording apparatus according to an embodiment.

FIG. 1 is a perspective view illustrating an ink jet recording apparatus 1 according to this embodiment.

First, the basic configuration of the ink jet recording apparatus 1 is described.

Ink Jet Recording Apparatus

The ink jet recording apparatus is an apparatus which records characters, drawings, images, and the like by discharging ink (ink composition), and then causing the ink to adhere to a recording medium by an ink jet type recording head. As the system of the ink jet type recording head, a piezoelectric system is used as a suitable example. The piezoelectric system is a system of applying pressure according to a recording information signal to ink by a piezoelectric element to eject ink droplets to perform recording.

The system of the ink jet type recording head is not limited thereto and may be another recording system of ejecting ink in the shape of liquid droplets, and then forming a dot group on a recording medium. For example, a system of continuously ejecting ink in the shape of liquid droplets from nozzles by liquid ejecting nozzles (hereinafter referred to as nozzles) and a strong electric field between accelerating electrodes disposed in front of the nozzles, and then giving a recording information signal from a deflecting electrode while the ink droplets are flying to thereby perform recording, a system of ejecting ink droplets according to a recording information signal without deflecting ink droplets (electrostatic suction system), a system of applying pressure to ink with a small pump, and then mechanically vibrating nozzles with a crystal oscillator or the like to thereby forcibly eject ink droplets, a system of heating and foaming ink with a microelectrode according to a recording information signal to eject ink droplets to perform recording (thermal jet system), and the like may be acceptable.

FIG. 1 is a perspective view illustrating the configuration of the ink jet recording apparatus 1 as an example according to an embodiment. In FIG. 1, the ink jet recording apparatus 1 is disposed on an almost horizontal X-Y plane.

The ink jet recording apparatus 1 has an ink jet type recording head (hereinafter referred to as a recording head 20), a carriage 3, a carriage driving mechanism 4, a control board 5, an ink cartridge 6, a recording medium supply/discharge mechanism (not illustrated), a platen 8, a wiper unit 30, and the like.

The carriage 3 carries the recording head 20 and the ink cartridge 6 and ejects ink (ink composition) in an approximately perpendicular direction (−Z direction in FIG. 1) while scanning (moving back and forth in the X direction in FIG. 1) the surface of the recording medium 10 with the carriage driving mechanism 4 to perform recording.

The control board 5 controls the drive of the carriage driving mechanism 4 and the wiper unit 30, the ink discharge, the supply/discharge of the recording medium 10, and the like.

The ink cartridge 6 is divided into a plurality of accommodation portions and accommodates a plurality of ink compositions described later.

The recording-medium supply/discharge mechanism moves the recording medium 10 in a direction crossing the scanning direction (Y direction in FIG. 1) of the carriage 3.

The platen 8 carries the recording medium 10 and defines the interval between the recording head 20 and the recording medium 10.

Recording Head

Figure 2A:
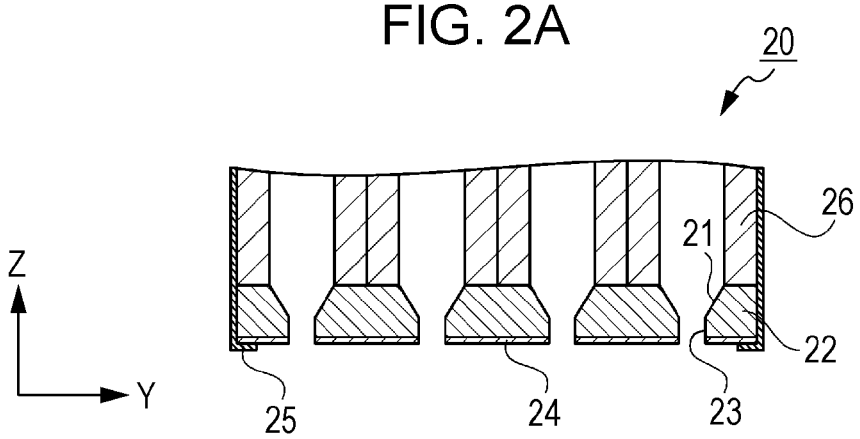
FIG. 2A is a cross sectional view illustrating a part of a head.

FIG. 2A is a cross sectional view illustrating a part of the recording head 20.

The recording head 20 has a nozzle plate 22 provided with a plurality of nozzles 21 which discharge an ink composition. In the nozzle plate 22, nozzle opening portions (discharge ports 23) are formed. On the surface of the nozzle plate 22, a liquid repellent film 24 is formed.

The nozzle plate 22 is provided with a nozzle plate cover 25 which covers at least one part of the nozzle plate 22. In the recording head 20 formed by the combination of a plurality of nozzle tips 26, the nozzle plate cover 25 is provided for a role of fixing the nozzle tips 26, a role of preventing floating of the recording medium 10 and direct contact of the recording medium 10 to the nozzle 21, and the like. The nozzle plate cover 25 covers at least one part of the nozzle plate 22, and thus is provided in a state where the nozzle plate cover 25 projects from the nozzle plate 22 as viewed from the side surface. The ink composition sometimes remains in the vicinity of the projection portion or the discharge ports 23, and therefore is removed by a wiping member 31 (FIGS. 3A and 3B) of the wiper unit 30 described later.

Figure 2B:
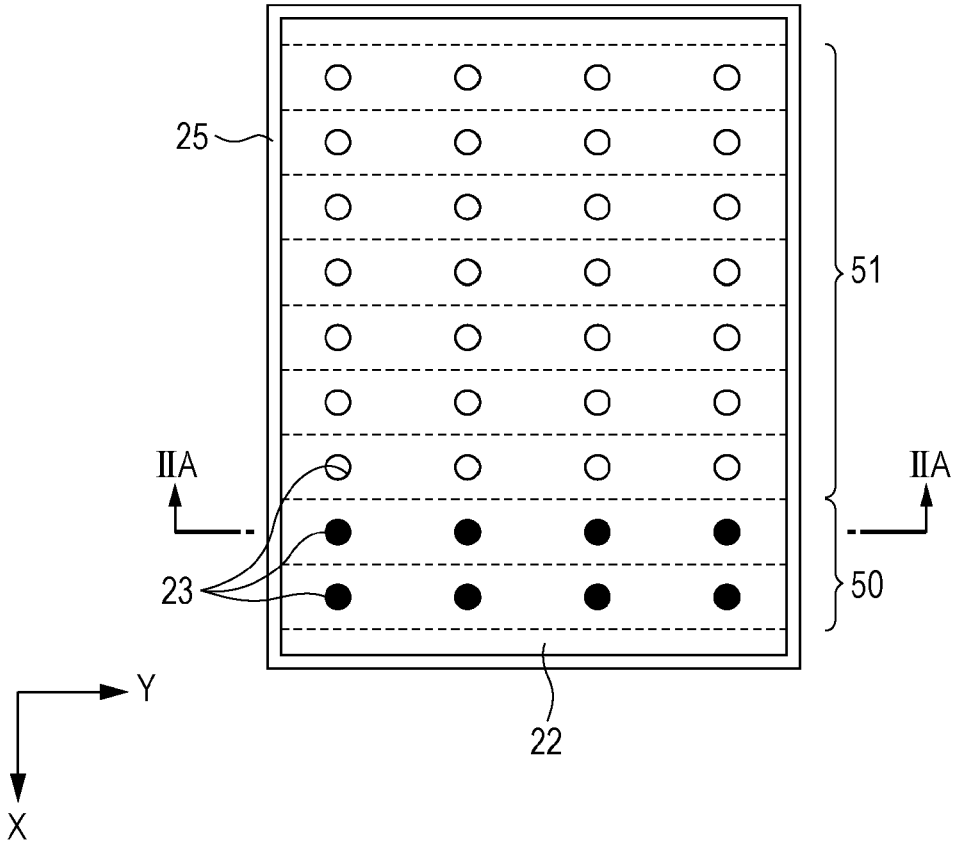
FIG. 2B is a plan view of a nozzle plate of the head.

FIG. 2B is a plan view of the nozzle plate 22 as viewed from the discharge port 23 side.

The nozzle plate 22 has first discharge port arrays 50 in which the discharge ports 23 which discharge an ink composition containing an inorganic pigment are disposed side by side and second discharge port arrays 51 in which discharge ports 23 of a plurality of nozzles which discharge an ink composition containing a coloring material other than the inorganic pigment are disposed side by side. In an example illustrated in FIG. 2B, the nozzle plate 22 has two first discharge port arrays 50 and seven second discharge port arrays 51 which are disposed side by side in the Y direction.

Although the explanation is reversed, FIG. 2A illustrates a cross section along the IIA-IIA line in FIG. 2B.

In FIG. 2B and the following figures, the arrays of the discharge ports 23 filled with black color indicate the first discharge port arrays 50.

Liquid Repellent Film

The liquid repellent film 24 is not particularly limited insofar as the film has liquid repellency. The liquid repellent film 24 can be formed by forming a molecular film of metal alkoxide having liquid repellency, and then subjecting the molecular film to dry treatment, annealing treatment, and the like, for example. The molecular film of metal alkoxide is not limited insofar as the film has liquid repellency and is desirably a monomolecular film of metal alkoxide having a long chain polymer group containing fluoride (a long chain RF group) or a monomolecular film of metal acid salt having a liquid repellent group (for example, a long chain polymer group containing fluoride). The metal alkoxide is not particularly limited and silicon, titanium, aluminum, and zirconium are generally used as metal species thereof, for example. As the long chain RF group, a perfluoroalkyl chain and a perfluoropolyether chain are mentioned, for example. As the alkoxysilane having the long chain RF group, a silane coupling agent having the long chain RF group and the like are mentioned, for example. As the liquid repellent film 24, a Silane Coupling Agent (SCA) film and one disclosed in U.S. Pat. No. 4,424,954 can also be used, for example.

With respect to the liquid repellent film 24, a conductive film is formed on the surface of the nozzle plate 22, and then the liquid repellent film 24 may be formed thereon or a ground film (PPSi (Plasma Polymerized Silicone) film) is formed by subjecting a silicon material to plasma polymerization in advance, and then the liquid repellent film 24 may be formed on the ground film. Due to the presence of the ground film therebetween, the silicon material of the nozzle plate 22 and the liquid repellent film 24 can be fitted to each other.

The liquid repellent film 24 preferably has a thickness of 1 nm or more and 30 nm or less. Due to the fact that the thickness is within such a thickness range, the nozzle plate 22 tends to be excellent in liquid repellency and the progress of degradation of the film is comparatively slow, so that the liquid repellency can be maintained for a longer period of time. Moreover, the liquid repellent film 24 having such a thickness is more excellent in terms of the cost and the ease of film formation. The liquid repellent film 24 has a thickness of more preferably 1 nm or more and 20 nm or less and still more preferably 1 nm or more and 15 nm or less from the viewpoint of the ease of film formation.

Wiper Unit

Figure 3A:
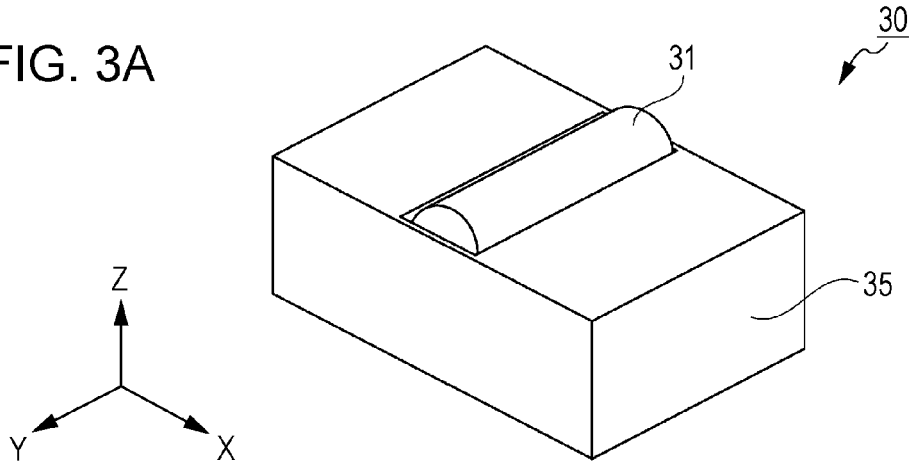
FIG. 3A is a perspective view illustrating a wiper unit.
Figure 3B:
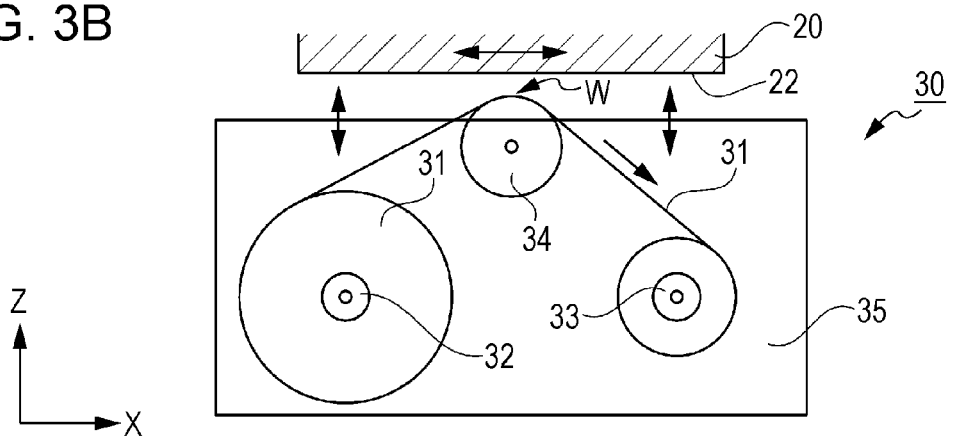
FIG. 3B is a side view illustrating the configuration of the wiper unit.
Figure 3C:
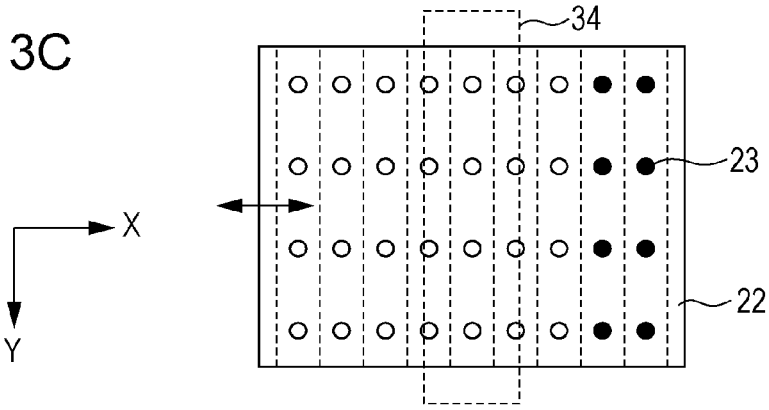
FIG. 3C is a plan view illustrating the position relationship of the wiper unit and discharge port arrays.

FIG. 3A is a perspective view illustrating the wiper unit 30. FIG. 3B is a side view illustrating the configuration of the wiper unit 30. FIG. 3C is a plan view illustrating the position relationship of the wiper unit 30 and the discharge port arrays.

The wiper unit 30 is constituted by the wiping member 31, a material supplying roller 32, a material removing roller 33, a pressing roller 34, a case 35, a wiper unit driving mechanism, and the like.

Inside the case 35, a pair of the material supplying roller 32 and the material removing roller 33 having an axis which horizontally extends in the Y direction serving as a lateral direction of the case 35 are accommodated with an interval in the X direction serving as the longitudinal direction of the case 35. Between the pair of the material supplying roller 32 and the material removing roller 33, an absorption member (wiping member 31) which wipes away ink remaining on the surface of the nozzle plate 22 is hooked. The material supplying roller 32 sends out an unused wound wiping member 31. The material removing roller 33 winds up the used wiping member 31 which is unwound from the material supplying roller 32, and then used in the wiping.

To the ceiling portion of the case 35, the pressing roller 34 having an axis which is almost parallel to the material supplying roller 32 and the material removing roller 33 is exposed from the case 35. The wiping member 31 sent out from the material supplying roller 32 is wound around the pressing roller 34, and then wound up by the material removing roller 33 after use.

As illustrated in FIG. 3C, the wiper unit 30 is disposed in such a manner that the axial direction of the pressing roller 34 is the same as the direction where the discharge ports 23 are disposed side by side in the first discharge port arrays 50 and the second discharge port arrays 51.

The wiper unit driving mechanism (not illustrated) has a function of moving (up and down) a wiping portion W of the wiping member 31 supported by the rotation moving of the material supplying roller 32 and the material removing roller 33 and the pressing roller 34 to the ink wiping position (height) of the nozzle plate 22 and these functions are controlled by the control board 5.

Wiping Member

The wiping member is not particularly limited insofar as it has absorbability to the inorganic pigment containing ink composition adhering to the discharge ports 23 of the nozzles and the nozzle plate 22 and is preferably one capable of holding a cleaning liquid described later. Due to the fact that the cleaning liquid is contained in the wiping member 31, the pigment particles easily move to the inside from the surface of the wiping member 31 and the pigment particles are difficult to remain on the surface of the wiping member 31, so that the liquid repellent film 24 is inhibited from being damaged by the pigment particles.

The wiping member 31 is not particularly limited and, cloth, sponge, pulp, and the like are mentioned, for example. Among the above, cloth is preferable. The cloth is easily bent and more easily wipes off adhering ink. The cloth is not particularly limited and those containing cupra, polyester, polyethylene, polypropylene, lyocell, rayon, and the like can be mentioned, for example. In this case, particularly when the material of the wiping member 31 is a nonwoven fabric (polyester) or cupra, fuzzing is difficult to occur. Therefore, ink is easily sucked from the nozzles and dot omission is more difficult to cause, and thus the materials are preferable.

The thickness of the wiping member 31 is preferably 0.1 mm or more and 3 mm or less. Due to the fact that the thickness is 0.1 mm or more, it becomes easier to hold the cleaning liquid. Due to the fact that the thickness is 3 mm or less, the wiping member 31 becomes more compact, so that the size of the wiper unit 30 can be reduced and it becomes easier to drive the wiper unit 30.

The surface density of the wiping member 31 is preferably 0.005 g/cm$^2$ or more and 0.15 g/cm$^2$ or less. The surface density is more preferably 0.02 g/cm$^2$ or more and 0.13 g/cm$^2$ or less. Due to the fact that the surface density is within the range mentioned above, it becomes easier to hold the cleaning liquid. Furthermore, for holding the cleaning liquid, it is preferable to use a nonwoven fabric, which is easy to design the surface density and the thickness, for the wiping member 31.

Cleaning Liquid

The cleaning liquid to be applied to the nozzle plate 22 preferably contains a penetrant and a humectant. Thus, the re-dispersibility of the solidified pigment particles improves, so that the pigment particles are more easily absorbed into the wiping member 31. The cleaning liquid is not particularly limited insofar as it is applied to the nozzle plate 22. The cleaning liquid may be applied by impregnating cloth or may be applied in the shape of mist. Or, the cleaning liquid may be collected on an application member, and then the collected cleaning liquid may be brought into contact with the nozzle plate. Among the above, the method for applying the cleaning liquid by impregnating cloth with the cleaning liquid is the most preferable. When impregnating cloth with the cleaning liquid, the cloth may be impregnated with the cleaning liquid when performing the cleaning operation. More specifically, cloth which is impregnated with the cleaning liquid in advance may be used or a mechanism of applying the cleaning liquid to cloth before performing cleaning operation may be provided.

The surface tension of the cleaning liquid is preferably 45 mN/m or less and more preferably 35 N/m or less. When the surface tension is low, the re-dispersibility of the inorganic pigment improves, the permeability of the inorganic pigment into an absorption member becomes good, and the wiping properties improve. As a method for measuring the surface tension, a method for measuring the surface tension at a liquid temperature of 25° C. by the Wilhelmy method using a generally used surface tension meter (for example, Surface tension meter CBVP-Z, manufactured by Kyowa Interface Science Co., LTD. and the like) can be mentioned.

The content of the cleaning liquid is preferably 10% by mass or more and 200% by mass or less, more preferably 10% by mass or more and 120% by mass or less, and still more preferably 30% by mass or more and 100% by mass based on 100% by mass of the absorption member. Due to the fact that the content is 10% by mass or more, the inorganic pigment ink is easily infiltrated into the absorption member, and the liquid repellent film 24 can be further inhibited from being damaged. Moreover, due to the fact that the content is 200% by mass or less, the remaining of the cleaning liquid on the nozzle plate 22 can be further suppressed, dot omission resulting from entering of air bubbles into the nozzles with the cleaning liquid, and dot omission resulting from entering of the cleaning liquid itself into the nozzles can be further suppressed.

In addition thereto, additives (components) which may be contained in the cleaning liquid are not particularly limited and resin, an antifoaming agent, a surfactant, water, an organic solvent, a pH adjuster, and the like are mentioned, for example. Each of the above-mentioned components may be used singly or in combination of two or more kinds thereof and the content is not particularly limited.

When the cleaning liquid contains an antifoaming agent, the cleaning liquid remaining on the nozzle plate 22 after the cleaning treatment can be effectively prevented from foaming. The cleaning liquid sometimes contains a large amount of acid humectants, such as polyethylene glycol and glycerin. When the cleaning liquid contains a pH adjuster in that case, the acidic cleaning liquid can be prevented from contacting the ink composition (usually basic with a pH of 7.5 or more). Thus, the ink composition can be prevented from shifting to the acidity side and the storage stability of the ink composition is further maintained.

As the humectant which may be contained in the cleaning liquid, any substance can be used without particular limitation insofar as the substance can be generally used in ink and the like. The humectant is not particularly limited and a high boiling point humectant whose boiling point under a pressure equivalent to one atmospheric pressure is preferably 180° C. or higher and more preferably 200° C. or higher can be used. When the boiling point is within the range mentioned above, volatile components in the cleaning liquid can be prevented from volatilizing and the inorganic pigment containing ink composition in contact with the cleaning liquid can be favorably wetted and effectively wiped away.

The high boiling point humectant is not particularly limited and, for example, ethylene glycol, propylene glycol, diethylene glycol, triethylene glycol, pentamethylene glycol, trimethylene glycol, 2-butene-1,4-diol, 2-ethyl-1,3-hexanediol, 2-methyl-2,4-pentanediol, tripropyrene glycol, polyethylene glycol, polypropylene glycol, 1,3-propylene glycol, isopropylene glycol, isobutylene glycol, glycerin, mesoerythritol, pentaerythritol, and the like are mentioned.

The humectant may be used singly or in combination of two or more kinds thereof. The content of the humectant is preferably 10 to 100% by mass based on the total mass (100% by mass) of the cleaning liquid. The state that the content of the humectant is 100% by mass based on the total mass of cleaning liquid indicates that all the components of the cleaning liquid are humectants.

Among the additives which may be contained in the cleaning liquid, the penetrant is described. The penetrant can be used without particular limitation insofar as it can be generally used in ink and the like. In a solution containing 90% by mass of water and 10% by mass of the penetrant, those which achieve a surface tension of 45 mN/m or less in the solution can also be employed as the penetrant. The penetrant is not particularly limited and one or more kinds selected from the group consisting of alkanediols and glycol ethers having 5 to 8 carbon atoms, an acetylene glycol surfactant, a siloxane surfactant, and a fluorine surfactant, are mentioned, for example. The measurement of the surface tension can be performed by the method described above.

The content of the penetrant in the cleaning liquid is preferably 1% by mass or more and 40% by mass or less and more preferably 3% by mass or more and 25% by mass or less. Due to the fact that the content is 1% by mass or more, the wiping properties tend to be more excellent. Due to the fact that the content is 40% by mass or less, it can be avoided that the penetrant attacks the pigment contained in the ink in the vicinity of the nozzle, so that the dispersion stability thereof deteriorates to cause aggregation thereof.

Moving Mechanism

The moving mechanism performs cleaning operation of moving at least one of the wiping member 31 and the recording head 20 relatively to the other one, and then wiping the surface of the nozzle plate 22 by the wiping member 31 to remove the ink composition adhering to the surface of the nozzle plate 22. Specifically, the moving mechanism is constituted by the carriage driving mechanism 4, a wiper unit driving mechanism, and the like, and is controlled by the control board 5.

The wiper unit driving mechanism has a pressing function of pressing the wiping member 31 against the surface of the nozzle plate 22 by relatively moving the wiping member 31 and the nozzle plate 22. The pressing load is preferably 50 gf or more and 700 gf or less, more preferably 50 gf or more and 500 gf or less, and still more preferably 75 gf or more and 300 gf or less. The pressing function may be configured to press the wiping member 31 against the nozzle plate 22 or may be configured to move the recording head 20 to press the same against the wiping member 31. Due to the fact that the pressing force is 50 gf or more, the ink wiping properties are excellent. Furthermore, even when there is a level difference formed between the nozzle plate 22 and the nozzle plate cover 25, it is excellent in preventing the ink adhering to a gap thereof from accumulating or removing the ink from the gap. Due to the fact that the pressing force is 500 gf or less, the storageability of the liquid repellent film 24 is further excellent.

The load as used herein refers to the total load applied to the nozzle plate 22 from the entire driving mechanism.

Furthermore, the moving mechanism is preferably one which relatively (the X direction) moves the wiping member 31 and the recording head 20 after pressing at a speed of 1 cm/s or more and 10 cm/s or less. By moving the same within the speed range, the cleaning properties and the storageability of the liquid repellent film 24 further improve.

The moving mechanism in the X direction may be provided in either or both of the carriage driving mechanism 4 and the wiper unit driving mechanism.

The pressing roller 34 described above is not particularly limited and those covered with an elastic member are preferable, for example. The Shore A hardness of the elastic member is preferably 10 or more and 60 or less and more preferably 10 or more and 50 or less. Thus, the pressing roller 34 and the wiping member 31 bend in pressing to be able to press the wiping member 31 into a concave portion of a concave-convex surface of the nozzle plate 22. Particularly when the nozzle plate cover 25 is provided, the wiping member 31 can be pressed into the deep side of a corner (gap) between the nozzle plate 22 and the nozzle plate cover 25 projecting therefrom, so that deposition of the ink can be suppressed. Therefore, the cleaning properties further improve.

Ink Composition

Next, additives (components) which are contained or may be contained in an ink composition containing an inorganic pigment (hereinafter referred to as an inorganic pigment containing ink composition) and an ink composition containing a coloring material other than the inorganic pigment (hereinafter referred to as a non-inorganic pigment containing ink composition) are described. The ink compositions contain coloring materials (inorganic pigments, organic pigments, dyes, and the like), solvents (water, organic solvents, and the like), resin, surfactants, and the like.

Coloring Material

The inorganic pigment containing ink composition contains an inorganic pigment as a coloring material within a range of 1.0% by mass or more and 20.0% by mass or less. In particular, when the inorganic pigment containing ink composition is a white ink composition, the inorganic pigment concentration is preferably 5% by mass or more.

The non-inorganic pigment containing ink composition may also contain a coloring material selected from pigments and dyes other than inorganic pigments.

Pigment

The inorganic pigment contained in the inorganic pigment containing ink composition has an average particle diameter of preferably 20 nm or more and 250 nm or less and more preferably 20 nm or more and 200 nm or less.

The needle shape ratio of the inorganic pigment is preferably 3.0 or less. By setting the needle shape ratio as described above, the liquid repellent film can be favorably protected in an aspect of the invention of this application. The needle shape ratio is a value obtained by dividing the maximum length of each particle by the minimum width thereof (Needle shape ratio=Maximum length of particle/Minimum width of particle. The specification of the needle shape ratio can be measured using a transmission electron microscope.

The Mohs' hardness of the inorganic pigment exceeds 2.0 and is preferably 5 or more and 8 or less.

Mentioned as the inorganic pigment are, for example, simple metals, such as carbon black, gold, silver, copper, aluminum, nickel, and zinc; oxides, such as cerium oxide, chromium oxide, aluminum oxide, zinc oxide, magnesium oxide, silicon oxide, tin oxide, zirconium dioxide, iron oxide, and titanium oxide; sulfates, such as calcium sulfate, barium sulfate, and aluminum sulfate; silicates, such as calcium silicate and magnesium silicate; nitrides, such as boron nitride and titanium nitride; carbides, such as silicon carbide, titanium carbide, boron carbide, tungsten carbide, and zirconium carbide; borides, such as zirconium boride and titanium boride; and the like. Among the above, aluminum, aluminum oxide, titanium oxide, zinc oxide, zirconium oxide, silicon oxide, and the like are mentioned as preferable inorganic pigments. More preferably, titanium oxide, silicon oxide, and aluminum oxide are mentioned. With respect to titanium oxide, the Mohs' hardness of the rutile type is about 7 to 7.5 and the Mohs' hardness of the anatase type is about 6.6 to 6. The manufacturing cost of the rutile type titanium oxide is low and the rutile type titanium oxide has a preferable crystal system and can demonstrate a good degree of whiteness. Therefore, when the rutile type titanium oxide is used, an ink jet recording apparatus which has liquid repellent film storageability, whose cost is low, and which can produce a recorded substance with good degree of whiteness is obtained.

The organic pigments are not particularly limited and include, for example quinacridone pigments, quinacridone quinone pigments, dioxazine pigments, phthalocyanine pigments, anthrapyrimidine pigments, anthanthrone pigments, indanthrone pigments, flavanthrone pigments, perylene pigments, diketopyrrolopyrrole pigments, perinone pigments, quinophthalone pigments, anthraquinone pigments, thioindigo pigment, benzimidazolone pigments, isoindolinone pigments, azomethine pigments, azo pigments, and the like. As a specific example of the organic pigments, the following substances are mentioned.

As pigments for use in cyan ink, C. I. Pigment Blue 1, 2, 3, 15, 15:1, 15:2, 15:3, 15:4, 15:6, 15:34, 16, 18, 22, 60, 65, and 66, C. I. Vat Blue 4, and 60, and the like are mentioned. Among the above, at least any one of C. I. Pigment Blue 15:3 and 15:4 is preferable.

As pigments for use in magenta ink, C. I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, and 264, C. I. Pigment Violet 19, 23, 32, 33, 36, 38, 43, and 50, and the like are mentioned. Among the above, one or more kinds selected from the group consisting of C. I. Pigment Red 122, C. I. Pigment Red 202, and C. I. Pigment Violet 19 are preferable.

As pigments for use in yellow ink, C. I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213 and the like are mentioned. Among the above, one or more kinds selected from the group consisting of C. I. Pigment Yellow 74, 155, and 213 are preferable.

As pigments for use in inks of colors other than the colors mentioned above, such as green ink and orange ink, known pigments are mentioned.

The average particle diameter of the pigments other than the inorganic pigments is preferably 250 nm or less because clogging of nozzles can be suppressed and more favorable discharge stability is achieved.

The average particle diameter in this specification is one based on volume. As the measuring method, the average particle diameter can be measured with a particle size distribution meter employing a laser diffraction scattering method as the measurement principle, for example. As the particle size distribution meter, a particle size distribution meter (for example, Microtrac UPA manufactured by Nikkiso Co., Ltd.) employing a dynamic light scattering method as the measurement principle is mentioned, for example.

Dye

As the coloring material, dyes can be used. The dyes are not particularly limited and acid dyes, direct dyes, reactive dyes, and basic dyes can be used.

The content of the coloring material is preferably 0.4 to 12% by mass and more preferably 2 to 5% by mass based on the total mass (100% by mass) of the ink composition.

Resin

As resin, a resin dispersant, a resin emulsion, wax, and the like are mentioned, for example. Among the above, an emulsion has good adhesiveness and abrasion resistance and thus is preferable.

The inorganic pigment containing ink composition is preferably one having the following characteristic (1) or (2) in terms of composition.

(1) The ink composition for ink jet recording contains a first resin with a thermal deformation temperature of 10° C. or less (hereinafter referred to as a "first ink").

(2) The ink composition for ink jet recording contains a second resin and does not substantially contain glycerin (hereinafter referred to as a "second ink").

These ink compositions have a property of easily solidifying on the nozzle formation surface and the absorption member and have a tendency of promoting damages to the liquid repellent film but the problems can be favorably prevented in the case of the invention of this application.

The first ink contains the first resin with a thermal deformation temperature of 10° C. or less. Such a resin has a property of firmly sticking to materials which are rich in flexibility and absorbability, such as cloth. On the other hand, film formation and solidification rapidly proceeds, so that the resin adheres in the form of a solid to the nozzle formation surface, an absorption material, and the like.

The second ink does not substantially contain glycerin whose boiling point under one atmospheric pressure is 290° C. When colored ink substantially contains glycerin, the drying properties of the ink sharply decrease. As a result, density unevenness of an image is noticeable and also the fixability of ink is not obtained on various recording media, particularly non-ink absorbing or low ink absorbing recording media. Moreover, due to the fact that glycerin is not contained, moisture and the like serving as the main solvent in the ink rapidly volatilize, so that the proportion of the organic solvent in the second ink increases. In this case, the thermal deformation temperature (particularly film formation temperature) of the resin decreases, so that solidification by a coating is further accelerated. Furthermore, it is preferable not to substantially contain alkylpolyols (excluding the glycerin mentioned above) whose boiling point under one atmospheric pressure is 280° C. or higher. In the case of the second ink, when a recording apparatus having a heating mechanism which heats a recording medium transported to a position facing a recording head is used, drying of the ink near the recording head proceeds, and the problems becomes more remarkable. However, the problem can be favorably prevented in the case of the invention of this application. When the heating temperature is 30° C. or higher and 80° C. or less, the temperature is preferable from the viewpoint of the storage stability of the ink and the recorded image quality. The heating mechanism is not particularly limited and a heat generating heater, a hot air heater, an infrared heater, and the like are mentioned.

Herein, the description of "does not substantially contain" in this specification means that a substance is not compounded with an amount equal to or larger than such an amount that the meaning of adding the substance is sufficiently demonstrated. When the amount is quantitatively indicated, glycerin is not contained in a proportion of preferably 1.0% by mass or more, more preferably 0.5% by mass or more, still more preferably 0.1% by mass or more, yet still more preferably 0.05% by mass, particularly preferably 0.01% by mass or more, and the most preferably 0.001% by mass based on the total mass (100% by mass) of the colored ink.

The thermal deformation temperature of the first resin is 10° C. or less. The thermal deformation temperature of the first resin is preferably −10° C. or less and more preferably −15° C. or less. When the glass transition temperature of a fixing resin is within the range mentioned above, the fixability of the pigment on a recorded substance becomes further excellent, which results in the fact that excellent abrasion resistance is achieved. The lower limit of the thermal deformation temperature is not particularly limited and may be −50° C. or higher.

The lower limit of the thermal deformation temperature of the second resin is preferably 40° C. or higher and more preferably 60° C. or higher because clogging of a head is difficult to cause and good abrasion resistance of a recorded substance can be achieved. A preferable upper limit is 100° C. or less.

Herein, the "thermal deformation temperature" in this specification is a temperature value indicated by the glass transition temperature (Tg) or the minimum film forming temperature (MFT). More specifically, the description that "the thermal deformation temperature is 40° C. or higher" means that either Tg or MFT may be 40° C. or higher. Since the re-dispersibility of the resin is more easily grasped by the MFT than by the Tg, the thermal deformation temperature is preferably a temperature value indicated by the MFT. In the case of the ink composition excellent in the re-dispersibility of resin, the ink composition does not firmly stick, and therefore it becomes difficult to cause clogging of a head.

The Tg in this specification is indicated by a value measured by a differential scanning calorimetry method. The MFT in this specification is indicated by a value measured by ISO 2115:1996 (Title: Plastics—Polymer dispersions—Determination of white point temperature and minimum film-forming temperature).

Resin Dispersant

When compounding the above-described pigment in the ink composition, the ink composition may contain a resin dispersant in order to achieve stable dispersion and holding of the pigment in water. Due to the fact that the ink composition contains a pigment dispersed using a resin dispersant, such as a water-soluble resin or a water dispersible resin (hereinafter referred to as a "resin dispersion pigment"), when the ink composition adheres to the recording medium 10, at least one adhesiveness of the adhesiveness between the recording medium 10 and the ink composition and the adhesiveness between the recording medium 10 and a solid in the ink composition can be rendered good. Among resin dispersants, the water-soluble resin is preferable because the dispersion stability is excellent.

Resin Emulsion

The ink composition may also contain a resin emulsion. The resin emulsion demonstrates an effect of sufficiently fixing the ink composition onto the recording medium 10 by forming a resin coating to achieve good abrasion resistance of an image. Due to the above-described effect, a recorded substance obtained by performing recording using the ink composition containing the resin emulsion achieves excellent adhesiveness and abrasion resistance particularly on cloth or the non-ink absorbing or low-ink absorbing recording medium recording medium 10. On the other hand, the solidification of the inorganic pigment tends to be accelerated but the problem of degradation of the liquid repellent film caused by wiping away a solidified adherent can be favorably prevented in the case of the invention of this application.

It is preferable for the resin emulsion functioning as a binder to be contained in the ink composition in the form of an emulsion. By compounding the resin functioning as a binder in the ink composition in the state of an emulsion, the viscosity of the ink composition is easily adjusted within a proper range by an ink jet recording system and excellent storage stability and discharge stability of the ink composition are achieved.

The resin emulsion is not particularly limited and, for example, includes homopolymers or copolymers of (meth) acrylic acid, (meth)acrylic ester, acrylonitrile, cyanoacrylate, acryl amide, olefin, styrene, vinyl acetate, vinyl chloride, vinyl alcohol, vinyl ether, vinyl pyrrolidone, vinyl pyridine, vinyl carbazole, vinyl imidazole, vinylidene chloride, fluororesin, natural resin, and the like. Among the above, at least either one of (meth)acrylic acid resin and styrene-(meth) acrylic acid copolymer resin is preferable, at least either one of acrylic acid resin and styrene-acrylic acid copolymer resin is more preferable, and styrene-acrylic acid copolymer system resin is still more preferable. The copolymer mentioned above may be any form of a random copolymer, a block copolymer, an alternating copolymer, and a graft copolymer.

As the resin emulsion, commercially-available items may be used or the resin emulsion may be produced using an emulsion polymerization method or the like as follows. As a method for obtaining the resin in the ink composition in the state of an emulsion, a method including performing emulsification polymerization of a monomer of the water-soluble resin mentioned above in water in the presence of a polymerization catalyst and an emulsifier is mentioned. A polymerization initiator, an emulsifier, and a molecular weight adjusting agent for use in the emulsification polymerization can be used according to known methods.

The average particle diameter of the resin emulsion is preferably in the range of 5 nm to 400 nm and more preferably in the range of 20 nm to 300 nm in order to achieve better storage stability and discharge stability of ink.

The resin emulsion may be used singly or in combination of two or more kinds thereof. The content of the resin emulsion among the resin is preferably in the range of 0.5 to 15% by mass based on the total mass (100% by mass) of the ink composition. When the content is within the range mentioned above, the solid content concentration can be reduced, and therefore better discharge stability can be achieved.

Wax

The ink composition may also contain wax. Due to the fact that the ink composition contains wax, the ink composition achieves more excellent fixability on the non-ink absorbing and the low-ink absorbing recording media 10. Among wax, an emulsion type or a suspension type is more preferable. The wax is not particularly limited to the following substances and polyethylene, paraffin wax, and polypropylene wax are mentioned, for example, and polyethylene wax described later is preferable.

Due to the fact that the ink composition contains polyethylene wax, excellent abrasion resistance of ink can be achieved.

The average particle diameter of the polyethylene wax is preferably in the range of 5 nm to 400 nm and more preferably in the range of 50 nm to 200 nm in order to achieve better storage stability and discharge stability of ink.

The content (in terms of solid content) of the polyethylene wax is preferably in the range of 0.1 to 3% by mass, more preferably in the range of 0.3 to 3% by mass, and still more preferably in the range of 0.3 to 1.5% by mass based on the total mass (100% by mass) of the ink composition. When the content is in the ranges mentioned above, the ink composition can be favorably solidified and fixed also on the recording medium 10 and more excellent storage stability and discharge stability of ink are achieved.

Antifoaming Agent

The ink composition preferably contains an antifoaming agent. In more detail, it is preferable for at least either the ink composition or the cleaning liquid of the wiping member 31 to contain an antifoaming agent. When the ink composition contains an antifoaming agent, foaming can be prevented and, as a result, a defect in which bubbles enter nozzles can be prevented.

The antifoaming agent is not limited to the following substances and, for example, includes a silicon antifoaming agent, a polyether antifoaming agent, a fatty acid ester antifoaming agent, an acetylene glycol antifoaming agent, and the like. Among the above, the silicon antifoaming agent and the acetylene glycol antifoaming agent are preferable because the capability of properly holding the surface tension and the interfacial tension and air bubbles are hardly produced. The HLB value based on the Griffin method of the antifoaming agent is more preferably 5 or less.

Surfactant

The ink composition may contain a surfactant (excluding those mentioned in the description of the antifoaming agent and, more specifically, limited to those whose HLB value obtained by the Griffin method exceeds 5). The surfactant is not limited to the following substances and, for example, includes nonionic surfactants. The nonionic surfactant has an action of uniformly spreading ink on the recording medium 10. Therefore, when ink jet recording is performed using an ink containing the nonionic surfactant, a high definition image in which blurring is difficult to occur is obtained. Such a nonionic surfactant is not limited to the following substances and, for example, include a silicon surfactant, a polyoxy ethylene alkyl ether surfactant, a polyoxypropylene alkyl ether surfactant, a polycyclic phenyl ether surfactant, a sorbitan derivative surfactant, a fluorine surfactant, and the like. Among the above, the silicon surfactant is preferable.

The silicon surfactant is excellent in the action of uniformly spreading ink in such a manner as not to cause blurring on the recording medium 10 as compared with other nonionic surfactants.

The surfactant may be used singly or in combination of two or more kinds thereof. The content of the surfactant is preferably in the range of 0.1% by mass or more and 3% by mass or less based on the total mass (100% by mass) of ink because better storage stability and discharge stability of ink are achieved.

Water

The ink composition may contain water. In particular, when the ink composition is an aqueous ink, water is a medium serving as the main component of the ink. When the recording medium 10 is heated in ink jet recording, water serves as a component which evaporates and scatters.

As water, those from which ionic impurities are removed as much as possible, such as pure water and ultrapure water, e.g., ion exchange water, ultra filtration water, reverse osmosis water, and distilled water, are mentioned, for example. When water sterilized by ultraviolet exposure, addition of hydrogen peroxide, and the like is used, generation of mold or bacteria can be prevented when storing a pigment dispersion liquid and an ink containing the same over a long period of time.

The content of water is not particularly limited and may be determined as appropriate as required.

Surface Tension of Ink Composition

The surface tension of the ink composition is not particularly limited and is preferably 15 to 35 mN/m. Thus, the permeability to the absorption member of the ink composition and bleeding prevention properties in recording can be secured, and ink wiping properties in the cleaning operation improve. Also with respect to the surface tension of the ink composition, a method for measuring the surface tension using a generally used surface tension meter (for example, Surface tension meter CBVP-Z manufactured by Kyowa Interface Science Co., LTD. and the like) can be mentioned as described above. A difference between the surface tension of the ink composition and the surface tension of the cleaning liquid preferably has a relationship of less than 10 mN/m. Thus, when both the substances are mixed near nozzles, an excessive reduction in the surface tension of the ink composition can be prevented.

In the ink jet recording apparatus 1 of the basic configuration described above, specific embodiments in aspects of the invention when using the ink composition described above are described below.

The ink jet recording apparatus 1 has the nozzle plate 22, the wiping member 31 which wipes the surface of the nozzle plate 22, and the moving mechanism of varying the relative position of the nozzle plate 22 and the wiping member 31 described above. The nozzle plate 22 has first discharge port arrays 50 in which the discharge ports 23 of a plurality of nozzles 21 which discharge the inorganic pigment containing the ink composition are disposed side by side and second discharge port arrays 51 in which the discharge ports 23 of a plurality of nozzles 21 which discharge the non-inorganic pigment containing the ink composition are disposed side by side.

Embodiment 1

In the ink jet recording apparatus 1 according to Embodiment 1, the first discharge port arrays 50 and the second discharge port arrays 51 are arranged in such a manner that the second discharge port arrays 51 are wiped in priority to the first discharge port arrays 50 in a series of the operations in which the surface of the nozzle plate 22 is wiped by the wiping member 31. Hereinafter, a specific description is given.

Figure 4A:
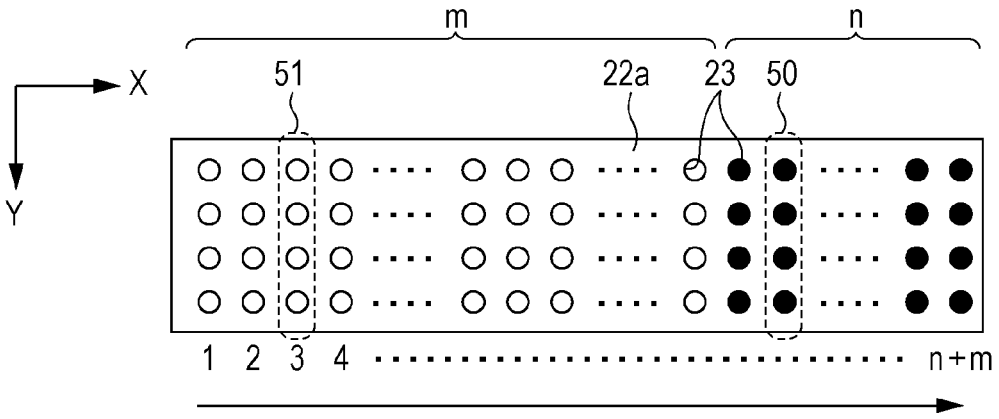
FIG. 4A is a plan view illustrating a nozzle plate according to Embodiment 1 as viewed from a discharge port side.

FIG. 4A is a plan view of the nozzle plate 22 (hereinafter referred to as a nozzle plate 22*a*) according to Embodiment 1 as viewed from the discharge port 23 side.

The nozzle plate 22*a* has n pieces of the first discharge port arrays 50 and m pieces of the second discharge port arrays 51. On the nozzle plate 22*a*, n pieces of the first discharge port arrays 50 are continuously arranged on one side (+X side in FIG. 4A) (i.e., n pieces of the first discharge port arrays 50 are continuously arranged from one end portion). On the nozzle plate 22*a*, m pieces of the second discharge port arrays 51 are continuously arranged on the other side (−X side in FIG. 4A) (i.e., m pieces of the first discharge port arrays 50 are continuously arranged from the other end portion).

Wiping Operation

In such an arrangement of the discharge port arrays in the nozzle plate 22*a*, a series of the wiping operations are performed as follows.

The moving mechanism, first, relatively moves the wiping member 31 and the nozzle plate 22*a* in such a manner that the wiping portion W (refer to FIG. 3B) in which the wiping member 31 is exposed from the case 35 of the wiper unit 30 is located at the other end portion (end portion on the side of −X of FIG. 4A) of the nozzle plate 22*a*.

Next, the wiper unit driving mechanism moves the wiping portion W in such a manner as to abut on the surface of the nozzle plate 22*a* with a predetermined pressing force.

Next, the wiper unit 30 and the nozzle plate 22*a* are relatively moved in such a manner that the wiping portion W of the wiping member 31 moves in the direction (the +X direction toward one end portion of the nozzle plate 22*a*) indicated by the arrow illustrated in FIG. 4A to the nozzle plate 22*a*, and then wipes the surface of the nozzle plate 22*a*.

As a result, the wiping portion W of the wiping member 31 first wipes the second discharge port arrays 51. Then, the remaining (m−1 pieces) second discharge port arrays 51 are continuously wiped in priority to the first discharge port arrays 50. After all the second discharge port arrays 51 are wiped, the n pieces of the first discharge port array 50 are continuously wiped.

After all the discharge port arrays (n+m pieces) are wiped, the wiper unit driving mechanism moves the wiping member 31 from the nozzle plate 22*a*, drives the material supplying roller 32 and the material removing roller 33 to draw out a new surface of the wiping member 31 from the material supplying roller 32 side and exposes the same, and then feeding the surface used for the wiping to the material removing roller 33 side to wind up the same.

A series of the wiping operations are controlled by the control board 5 provided in the ink jet recording apparatus 1.

According to the ink jet recording apparatus 1 of this embodiment, the following effects can be obtained as described above.

Due to the fact that the surface of the nozzle plate 22 is wiped by the wiping member 31, poor discharge caused by an increase in viscosity of the ink composition and adhesion of foreign substances to the nozzle plate 22 is prevented or reduced. Moreover, in a series of the wiping operations in which the surface of the nozzle plate 22 is wiped by the wiping member, the second discharge port arrays 51 which discharge the ink composition containing a coloring material other than an inorganic pigment are wiped in priority to the first discharge port arrays 50 which discharge the ink composition containing an inorganic pigment, and then the first discharge port arrays 50 are wiped. Due to the fact that the second discharge port arrays 51 are wiped in priority to the first discharge port arrays 50, a state where the inorganic pigment is present between the wiping member 31 and the surface of the nozzle plate 22 in a series of the wiping operations is difficult to occur. When the first discharge port arrays 50 are wiped, the inorganic pigment is sometimes pressed against the surface of the nozzle plate 22 by the wiping member 31 to rub the surface of the nozzle plate 22. Therefore, the surface of the nozzle plate 22 is sometimes damaged in the vicinity of the first discharge port arrays 50. However, since the second discharge port arrays are wiped in priority to the first discharge port arrays 50 in a state where the inorganic pigment is not present, the damages to the surface of the nozzle plate 22 are suppressed.

Thus, according to this embodiment, the state where the inorganic pigment discharged from the first discharge port arrays 50 and adheres to the nozzle plate 22 damages the entire surface of the nozzle plate 22 while being applied and spread to the second discharge port arrays 51 does not occur, so that the damage degree can be reduced. As a result, even in the case of the configuration in which the liquid repellent film 24 is provided on the surface of the nozzle plate 22, the degradation of the liquid repellent film 24 over the entire nozzle plate 22 is suppressed. Therefore, the discharge of the ink composition can be maintained in a more stable state.

Since the first discharge port arrays 50 and the second discharge port arrays 51 are arranged in such a manner that the second discharge port arrays 51 are wiped in priority to the first discharge port arrays 50 in the wiping operation in which the relative position of the nozzle plate 22 and the wiping member 31 varies in a single direction, the above-described effects can be obtained by the simple wiping operation.

Embodiment 2

Next, an ink jet recording apparatus 1 according to Embodiment 2 is described. In the description, the same constituent portions as those of the embodiment described above are denoted by the same reference numbers and the duplicated description is omitted.

In Embodiment 2, in n pieces of the first discharge port arrays 50 and m pieces of the second discharge port arrays 51, the number given by n+m is even, k=(n+m)/2 is established and when the number given by n+m is odd, k=(n+m−1)/2 is established. In such a case, in a series of the operations in which the wiping member 31 wipes the surface of the nozzle plate 22 in such a manner as to wipe the first discharge port arrays 50 or the second discharge port arrays 51 of the first array to the n+m-th array, the first discharge port arrays 50 and the second discharge port arrays 51 are arranged in such a manner that the first discharge port array 50 of the n-th array is wiped in the range of the k+1-th array to the n+m-th array. Hereinafter, a specific description is given.

Figure 4B:
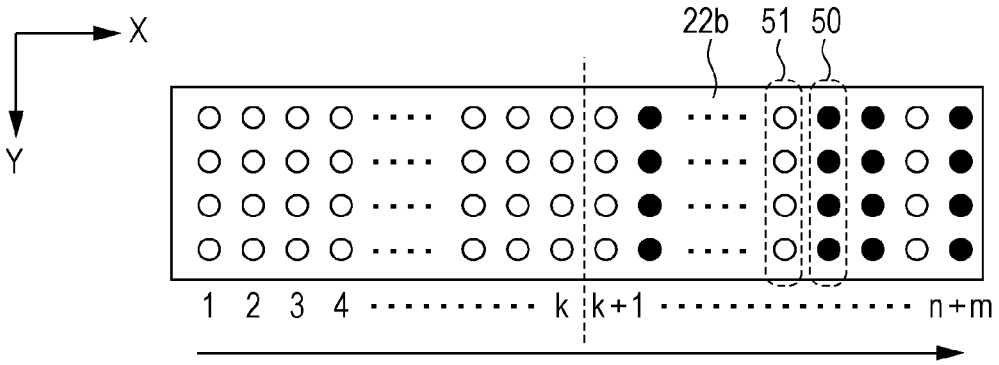
FIG. 4B is a plan view illustrating a nozzle plate according to Embodiment 2 as viewed from a discharge port side.

FIG. 4B is a plan view of the nozzle plate 22 (hereinafter referred to as a nozzle plate 22*b*) according to Embodiment 2 as viewed from the discharge port 23 side.

Embodiment 2 is the same as Embodiment 1 except that the arrangement of the first discharge port arrays 50 and the second discharge port arrays 51 on the nozzle plate 22*b* is different from the arrangement thereof in the case of the nozzle plate 22*a*.

Embodiment 1 describes that n pieces of the first discharge port arrays 50 are continuously arranged from one end portion on the nozzle plate 22*a* and *m* pieces of the second discharge port arrays 51 are continuously arranged from the other end portion on the nozzle plate 22*a*. On the other hand, on the nozzle plate 22*b*, n pieces of the first discharge port arrays 50 and m pieces of the second discharge port arrays 51 are not always continuously arranged. As illustrated in FIG. 4B, some second discharge port arrays 51 are present between the arrays of the n pieces of the first discharge port arrays 50. With respect to the n pieces of the first discharge port arrays 50, in the arrangement of the first array (array on the other end side portion of the nozzle plate 22*b*) to the n+m-th array (array of one end portion of the nozzle plate 22*b*), n pieces of arrays of the first discharge port arrays 50 are arranged in the range of the k+1-th array to the n+m-th array. More specifically, all the n pieces of the first discharge port arrays 50 in which the discharge ports 23 which discharge the inorganic pigment containing ink composition are disposed side by side are arranged on or behind almost the center (between the k-th array and the k+1-th array or a portion where the k+1-array is positioned at the center).

According to the ink jet recording apparatus 1 according to this embodiment, the following effects can be obtained.

In a series of the wiping operations in which the surface of the nozzle plate 22 is wiped by the wiping member 31, all the first discharge port arrays 50 in which the ink composition containing an inorganic pigment is discharged are wiped in the latter half of the sequence of the discharge port arrays to be wiped (in the range of the k−1-th array to the n+m-th array). Due to the fact that the first discharge port arrays 50 are wiped in the latter half, the state where the inorganic pigment is present between the wiping member 31 and the nozzle plate 22 surface decreases in a series of the wiping operations does not occur.

More specifically, according to this embodiment, the inorganic pigment discharged from the first discharge port arrays 50 and adheres to the nozzle plate 22 damages the entire surface of the nozzle plate 22 while being applied and spread to the second discharge port arrays 51 is difficult to occur, so that the degree of the damages can be reduced. As a result, even in the case of the configuration in which the liquid repellent film 24 is provided on the surface of the nozzle plate 22, the degradation of the liquid repellent film over the entire nozzle plate 22 is suppressed. Therefore, the discharge of the ink composition can be maintained in a more stable state.

Embodiment 3

Next, the ink jet recording apparatus 1 according to Embodiment 3 is described. In the description, the same constituent portions as those of the embodiments described above are denoted by the same reference numbers and the duplicated description is omitted.

In Embodiment 3, in n pieces of the first discharge port arrays 50 and m pieces of the second discharge port arrays 51, when the number given by n+m is even, k=(n+m)/2 is established and when the number given by n+m is odd, k=(n+m−1)/2 is established. In such a case, in a series of the operations in which the wiping member 31 wipes the surface of the nozzle plate 22 in such a manner as to wipe the first discharge port arrays 50 or the second discharge port arrays 51 of the first array to the n+m-th array, the first discharge port arrays 50 and the second discharge port arrays 51 are arranged in such a manner that the percentage in which the first discharge port arrays 50 are wiped in the range from the first array to the k-th array is smaller than the percentage in which the first discharge port arrays 50 are wiped in the range from the k+1-th array to the n+m-th array.

Figure 4C:
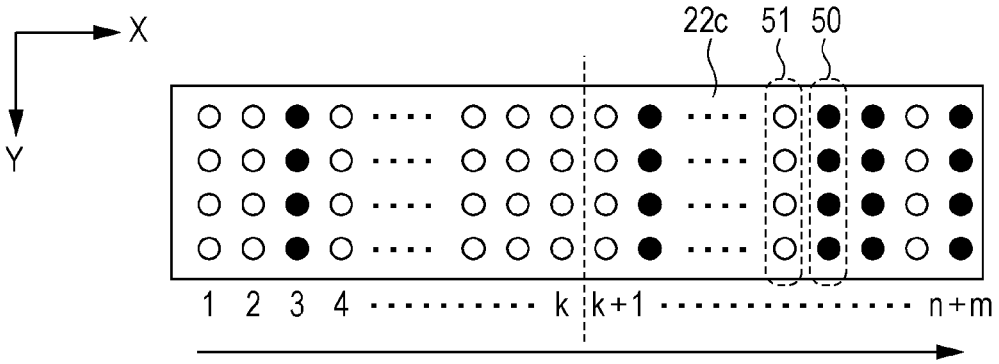
FIG. 4C is a plan view illustrating a nozzle plate according to Embodiment 3 as viewed from a discharge port side.

FIG. 4C is a plan view of the nozzle plate 22 (hereinafter referred to as a nozzle plate 22*c*) according to Embodiment 3 as viewed from the discharge port 23 side.

Embodiment 3 is the same as Embodiment 1 except that the arrangement of the first discharge port arrays 50 and the second discharge port arrays 51 on the nozzle plate 22*b* is different from the arrangement thereof in the case of the nozzle plate 22*a*.

Embodiment 1 describes that n pieces of the first discharge port arrays 50 are continuously arranged from one end portion on the nozzle plate 22*a* and *m* pieces of the second discharge port arrays 51 are continuously arranged from the other end portion on the nozzle plate 22*a*. On the other hand, on the nozzle plate 22*c*, n pieces of the first discharge port arrays 50 and m pieces of the second discharge port arrays 51 are not always continuously arranged. As illustrated in FIG. 4C, some second discharge port arrays 51 are present between the arrays of the n pieces of the first discharge port arrays 50 arranged from one end portion. Similarly, some first discharge port arrays 50 are present between the arrays of the m pieces of the second discharge port arrays 51 which are disposed side by side from the other end portion. The first discharge port arrays 50 are arranged in such a manner that the percentage of the first discharge port arrays 50 present in the range of the first array to the k-th array is smaller than the percentage of the first discharge port arrays 50 in the range of the k+1-th array to the n+m-th array.

According to the ink jet recording apparatus 1 of this embodiment, the following effects can be obtained.

In a series of the wiping operations in which the surface of the nozzle plate 22 is wiped by the wiping member 31, the percentage in which the first discharge port arrays 50 are wiped in the first half of the sequence of the arrays to be wiped (in the range of the first array to the k-th array) is smaller than the percentage in which the first discharge port arrays 50 are wiped in the latter half (in the range of the k+1-th array to the n+m-th array). In other words, the second discharge port arrays 51 are wiped in priority to the first discharge port arrays 50 in such a manner that the percentage in which the second discharge port arrays 51 are wiped in the first half is high. Due to the fact that the second discharge port arrays 51 are wiped in priority to the first discharge port arrays 50, the state where the inorganic pigment is present between the wiping member 31 and the nozzle plate 22 surface is more difficult to occur in a series of the wiping operations.

Thus, according to this embodiment, the inorganic pigment discharged from the first discharge port arrays 50 and adheres to the nozzle plate 22 damages the entire surface of the nozzle plate 22 while being applied and spread to the second discharge port arrays 51 is difficult to occur, so that the degree of the damages can be reduced. As a result, even in the case of the configuration in which the liquid repellent film 24 is provided on the surface of the nozzle plate 22, the degradation of the liquid repellent film over the entire nozzle plate 22 is suppressed. Therefore, the discharge of the ink composition can be maintained in a more stable state.

Embodiment 4

Next, an ink jet recording apparatus 1 according to Embodiment 4 is described. In the description, the same constituent portions as those of the embodiments described above are denoted by the same reference numbers and the duplicated description is omitted.

In Embodiment 4, the relative position of the nozzle plate 22 and the wiping member 31 is varied in such a manner that the second discharge port arrays 51 are wiped in priority to the first discharge port arrays 50 in a series of the operations in which the surface of the nozzle plate 22 is wiped by the wiping member 31. Hereinafter, a specific description is given.

Figure 5A:
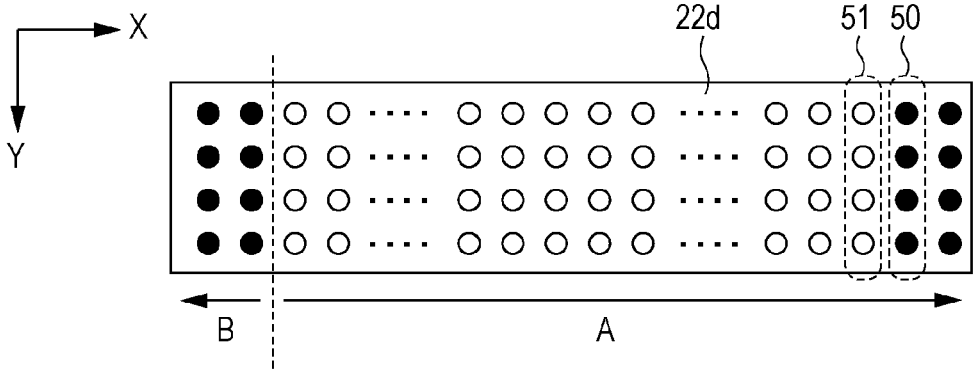
FIGS. 5A to 5C are plan views illustrating an example of a nozzle plate according to Embodiment 4 as viewed from a discharge port side.
Figure 5B:
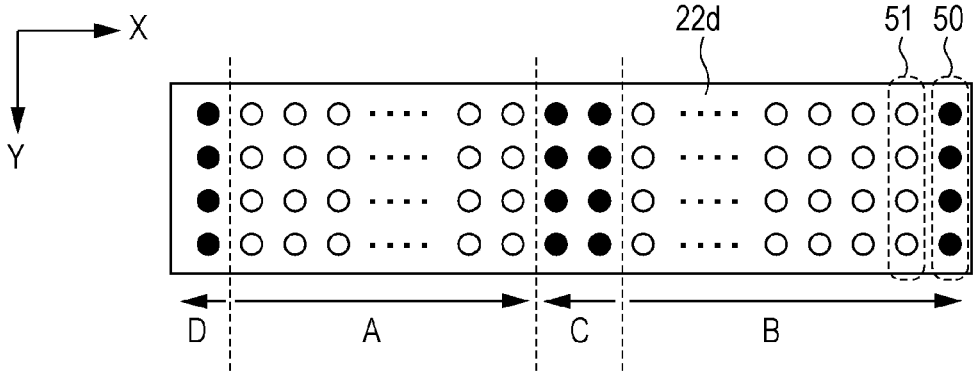
Figure 5C:
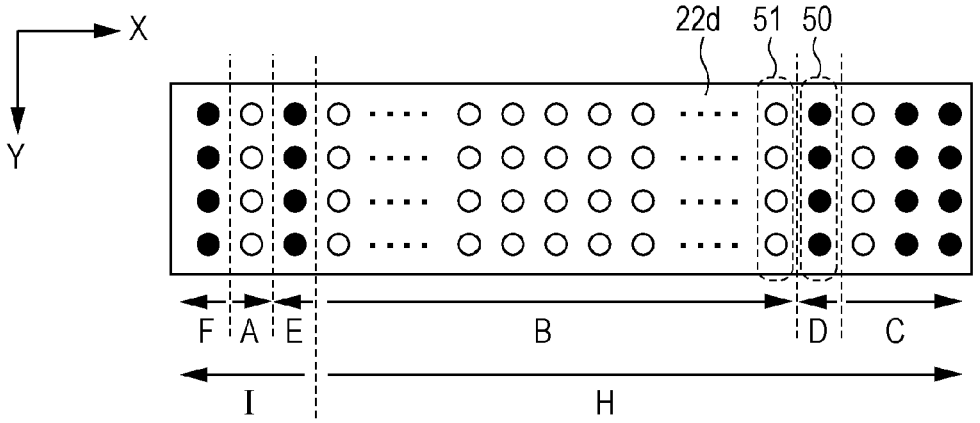

FIGS. 5A to 5C are plan views of an example of the nozzle plate 22 according to Embodiment 4 (hereinafter referred to as a nozzle plate 22*d*) as viewed from the discharge port 23 side.

Embodiment 4 is the same as Embodiment 1 except the respects that the arrangement of the first discharge port arrays 50 and the second discharge port arrays 51 on the nozzle plate 22*d* is not limited as in the case of the nozzle plate 22*a* and the wiping operation by the moving mechanism is not limited to a fixed direction.

Embodiment 1 describes that n pieces of the first discharge port arrays 50 are continuously arranged from one end portion on the nozzle plate 22*a* and *m* pieces of the second discharge port arrays 51 are continuously arranged from the other end portion on the nozzle plate 22*a*. On the other hand, the arrangement of the first discharge port arrays 50 and the second discharge port arrays 51 is not particularly limited on the nozzle plate 22*d*.

For example, in an example of the nozzle plate 22*d* illustrated in FIG. 5A, two arrays of the first discharge port arrays 50 are arranged on both end portions of the nozzle plate 22*d*. The second discharge port arrays 51 are continuously arranged in a range sandwiched between the first discharge port arrays 50 in both end regions.

Wiping Operation in Embodiment 4

A series of the wiping operations are performed to the arrangement described above as follows.

First, the moving mechanism relatively moves the wiping member 31 and the nozzle plate 22*d* in such a manner that the wiping portion W (refer to FIG. 3B) in which the wiping member 31 is exposed from the case 35 of the wiper unit 30 is located at the position of the second discharge port array 51 nearest to the other end portion (end portion on the −X side of FIG. 5A) of the nozzle plate 22*d*.

Next, the wiper unit driving mechanism moves the wiping portion W in such a manner as to abut on the surface of the nozzle plate 22*d* with a predetermined pressing force.

Next, the wiper unit 30 and the nozzle plate 22*d* are relatively moved in such a manner that the wiping portion W of the wiping member 31 moves in the direction (the +X direction toward one end portion of the nozzle plate 22*d*) indicated by the arrow illustrated in FIG. 5A to the nozzle plate 22*d* to wipe the surface of the nozzle plate 22*d*.

After the two arrays of the first discharge port array 50 arranged at one end portion are wiped, the wiper unit driving mechanism moves the wiping member 31 from the nozzle plate 22*d*, and then the moving mechanism relatively moves the wiping member 31 and the nozzle plate 22*d* in such a manner that the wiping portion W is located at the position of the nearer first discharge port array 50 of the two arrays of the first discharge port array 50 arranged at the other end portion.

Next, the wiper unit driving mechanism moves the wiping portion W to abut on the surface of the nozzle plate 22*d* with a predetermined pressing force.

Next, the wiper unit 30 and the nozzle plate 22*d* are relatively moved in such a manner that the wiping portion W of the wiping member 31 moves in the direction (the −X direction toward the other end portion of the nozzle plate 22*d*) indicated by the arrow B illustrated in FIG. 5A to the nozzle plate 22*d* to wipe the surface of the nozzle plate 22*d*.

After the two arrays of the first discharge port array 50 arranged at the other end portion are wiped, the wiper unit driving mechanism moves the wiping member 31 from the nozzle plate 22*d*, drives the material supplying roller 32 and the material removing roller 33 to draw out a new surface of the wiping member 31 and expose the same from the material supplying roller 32 side, and then feeding the surface used for the wiping to the material removing roller 33 side to wind the same up.

By a series of the wiping operations described above, the second discharge port arrays 51 are first wiped in priority to the first discharge port arrays 50, and then the first discharge port array 50 are continuously wiped.

For example, in an example of the nozzle plate 22*d* illustrated in FIG. 5B, the first discharge port arrays 50 are arranged on the both end portions and the central portion of the nozzle plate 22*d*. The second discharge port arrays 51 are continuously arranged in a range sandwiched by the first discharge port arrays 50 on both end regions and the first discharge port arrays 50 on the central portion.

To such an arrangement, a series of the wiping operations are performed in the order of ABCD as indicated by the arrows A to D illustrated in FIG. 5B. The arrows A to D show regions where the wiping portion W moves in such a manner as to wipe the surface of the nozzle plate 22*d*. Between each arrow, the wiping portion W is moved once from the surface of the nozzle plate 22*d* by the wiper unit driving mechanism, and is moved by the moving mechanism similarly as above.

For example, in an example of the nozzle plate 22*d* illustrated in FIG. 5C, the first discharge port arrays 50 are arranged in both end regions of the nozzle plate 22*d*. However, a portion where the first discharge port arrays 50 and the second discharge port arrays 51 are alternately arranged is also included.

To such an arrangement, a series of the wiping operations are performed in the order of A to F as indicated by the arrows A to F illustrated in FIG. 5C. The arrows A to F show regions where the wiping portion W moves in such a manner as to wipe the surface of the nozzle plate 22*d*. Between each arrow, the wiping portion W is moved once from the surface of the nozzle plate 22*d* by the wiper unit driving mechanism, and is moved by the moving mechanism similarly as above.

However, when the second discharge port arrays 51 are divided and arranged in a large number of regions as described above, the wiping operation controlled by the moving mechanism and the wiper unit driving mechanism becomes complicated, so that the wiping is not efficiently performed. In such a case, the wiping may be performed in a simple manner as indicated by the arrows H and I illustrated in FIG. 5C, for example. However, in this case, in a series of the wiping operations, the n-th first discharge port array 50 is required to be wiped in the range of the k+1-th array to the n+m-th array as in Embodiment 2 or at least the percentage in which the first discharge port arrays 50 are wiped in the range of the first array to the k-th array is smaller than the percentage in which the first discharge port arrays 50 are wiped in the range of the k+1-th array to the n+m-th array as in Embodiment 3.

Thus, according to the arrangement of the first discharge port arrays 50 and the second discharge port arrays 51 on the nozzle plate 22*d*, the position and order of the wiping are set as appropriate.

According to this embodiment, the moving mechanism vary the relative position of the nozzle plate 22 and the wiping member 31 in such a manner that the second discharge port arrays 51 are wiped in priority to the discharge port arrays 50 according to the arrangement of the first discharge port arrays 50 which discharge the ink composition containing an inorganic pigment and the second discharge port arrays 51 which discharge the ink composition containing a coloring material other than the inorganic pigment in a series of the wiping operations. In other words, the second discharge port arrays 51 are wiped in priority to the discharge port arrays 50 irrespective of the arrangement of the first discharge port arrays 50 and the second discharge port arrays 51. For example, in order to achieve recording of a high definition image at a high speed, even in the case of a configuration in which a plurality of the first discharge port arrays 50 are arranged at distant positions in such a manner as to sandwich a plurality of the second discharge port array 51 or, conversely, even in the case of a configuration in which the first discharge port arrays 50 are sandwiched between the second discharge port arrays 51, the relative position of the nozzle plate 22 and the wiping member 31 is varied, and then the wiping is carried out in such a manner that the second discharge port arrays 51 are wiped in priority to the first discharge port arrays 50. As a result, the same effects as those of the embodiments described above can be obtained, and the discharge of the ink composition can be maintained in a more stable state.

Thus, according to this embodiment, since the arrangement of the arrays of the discharge ports 23 of the nozzles on the nozzle plate 22, i.e., the arrangement of the nozzle arrays on the recording head 20, can be set to arrangement in which priority is given to the accuracy, the recording speed, and the like of a recorded image without considering the order of the wiping, an ink jet recording apparatus capable of recording a higher definition image at a high speed and having more excellent discharge stability can be provided.

Modification 1

Figure 6A:
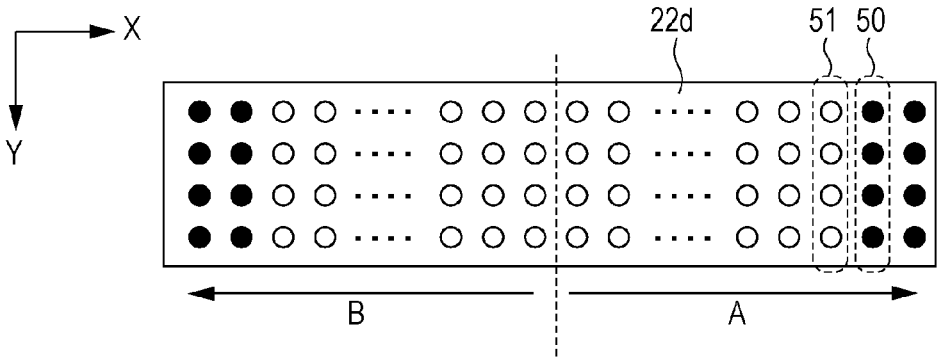
FIGS. 6A and 6B are plan views illustrating an example of a nozzle plate according to Modification as viewed from a discharge port side.
Figure 6B:
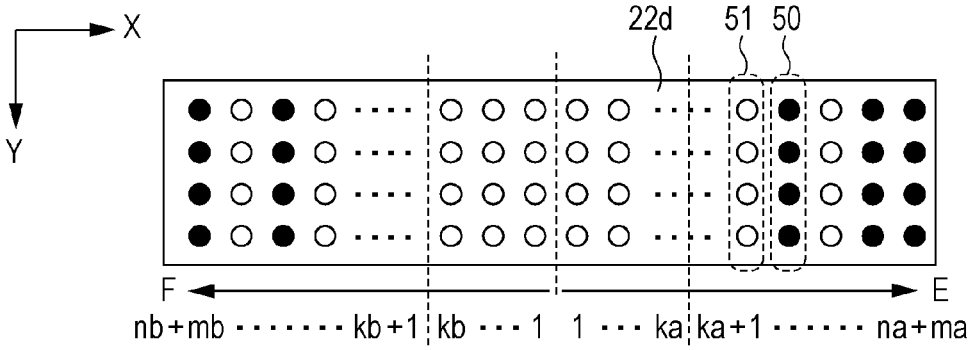

FIGS. 6A and 6B are plan views of an example of the nozzle plate 22*d* according to a modification as viewed from the discharge port 23 side.

Embodiment 1 describes that after the wiping of the nozzle plate 22 is completed by a series of the operations, the wiper unit driving mechanism drives the material supplying roller 32 and the material removing roller 33 to draw out a new surface of the wiping member 31 and expose the same from the material supplying roller 32 side, and then feeding the surface used for the wiping to the material removing roller 33 side to wind the same up. More specifically, it is described that the wiping portion W of the wiping member 31 does not vary until a series of the wiping is completed. However, the invention is not limited thereto and the wiping portion W may be refreshed (expose a new surface of the wiping member 31) during the wiping operation.

The nozzle plate 22*d* illustrated in FIG. 6A is an example in which two arrays of the first discharge port arrays 50 are disposed on both end portions of the nozzle plate 22*d* similarly as the example of the nozzle plate 22*d* illustrated in FIG. 5A. The second discharge port arrays 51 are continuously arranged in a range sandwiched by the first discharge port arrays 50 in both end regions.

In such an arrangement, the wiping can be efficiently performed by refreshing the wiping portion W during the wiping operation. Specifically, when the wiping portion W is refreshed after the first discharge port arrays 50 are wiped, the second discharge port array 51 can be successively favorably wiped. Therefore, the wiping toward both end portions of the nozzle plate 22*d* from the second discharge port arrays 51 arranged on the central portion of the nozzle plate 22*d* as the starting point as indicated by the arrows A and B illustrated in FIG. 6A can be performed. As a result, for example, in the case of the nozzle plate 22*d* having the arrangement of the example illustrated in FIG. 6A, the wiping toward both end portions from the central portion can be performed with good balance. Moreover, the wiping can be efficiently performed, e.g., the movement length for a series of the wiping (the varying amount of the relative position of the nozzle plate 22 and the wiping member 31) can also be shortened.

The nozzle plate 22*d* illustrated in FIG. 6B is an example including a portion where the first discharge port arrays 50 and the second discharge port arrays 51 are alternately arranged in the arrangement in which the first discharge port arrays 50 are arranged in both end regions of the nozzle plate 22*d* similarly as in the example of the nozzle plate 22*d* illustrated in FIG. 5C.

Also in such an arrangement, the wiping can be efficiently performed by refreshing the wiping portion W during the wiping operation similarly as above. Specifically, the wiping toward both end portions of the nozzle plate 22*d* from the second discharge port arrays 51 arranged on the central portion of the nozzle plate 22*d* as the starting point as indicated by the arrows E and F illustrated in FIG. 6B is performed.

In the wiping in the direction indicated by the arrow E, when na pieces of the first discharge port arrays 50 and ma pieces of the second discharge port arrays 51 are wiped, the following relationship is to be satisfied.

In the case where when the number given by na+ma is even, ka=(na+ma)/2 is established and when the number given by na+ma is odd, ka=(na+ma−1)/2 is established, the first discharge port arrays 50 and the second discharge port arrays 51 are arranged in such a manner that the first discharge port array 50 of the na-th array is wiped in the range of the ka+1-th array to the na+ma-th array. Or, at least, the arrays are arranged in such a manner that the percentage in which the first discharge port arrays 50 are wiped in a range of the first array to the ka-th array is smaller than the percentage in which the first discharge port arrays 50 are wiped in a range of the ka+1-th array to the na+ma-th array.

In the wiping in the direction indicated by the arrow F, when nb pieces of the first discharge port arrays 50 and mb pieces of the second discharge port arrays 51 are wiped, the following relationship is to be satisfied.

In the case where the number given by nb+mb is even, kb=(nb+mb)/2 is established and when the number given by nb+mb is odd, kb=(nb+mb−1)/2 is established, the first discharge port arrays 50 and the second discharge port arrays 51 are arranged in such a manner that the first discharge port array 50 of the nb-th array is wiped in a range of the kb+1-th array to the nb+mb-th array. Or, at least, the arrays are arranged in such a manner that the percentage in which the first discharge port array 50 are wiped in a range of the first array to the kb-th array is smaller than the percentage in which the first discharge port arrays 50 are wiped in a range of the kb+1-th array to the nb+mb-th array.

Due to the fact that the second discharge port arrays 51 are wiped in priority to the first discharge port arrays 50 as described above, the state where the inorganic pigment is present between the wiping member 31 and the surface of the nozzle plate 22 is difficult to occur in a series of the wiping operations. As a result, damages to the surface of the nozzle plate 22 are suppressed.

EXPERIMENTAL EXAMPLES

Experimental examples are described below. The invention is not limited at all to the following experimental examples.

Ink Composition

Main materials for the ink composition are as follows.

Coloring Material

C. I. Pigment Black 7 (Carbon black, Average particle diameter of 100 nm, Mohs' hardness of 1 to 2.0)

C. I. Pigment Blue 15:3 (Average particle diameter of 100 nm, Mohs' hardness of 1 or less)

C. I. Pigment Red 122 (Average particle diameter of 120 nm, Mohs' hardness of 1 or less)

C. I. Pigment Yellow 155 (Average particle diameter of 200 nm, Mohs' hardness of 1 or less)

Titanium dioxide (Average particle diameter of 350 nm, Mohs' hardness of 7.2)

Organic Solvent 1,2-hexane diol 2-pyrolidone

Propylene glycol

Resin Emulsion

Styrene-acrylic acid copolymer resin emulsion (Tg of 85° C., Average particle diameter of 140 nm)

Polyethylene Wax

AQUACER515 (Product name, manufactured by BYK)

Silicon Surfactant

BYK348 (Product name, manufactured by BYK)

Acetylene Glycol Antifoaming Agent

Surfynol DF110D (Product name, manufactured by Nisshin Chemical Co., Ltd., HLB value=3)

PH Adjuster

Triethanolamine

Method for Measuring Average Particle Diameter

The average particle diameter was measured according to "Microtrac UPA" (Product name) of Nikkiso Co., Ltd.

Method for Measuring Tg

The Tg was measured using a dried substance of an emulsion as a sample and using "DSC-6200R" (Product name) manufactured by SII Nano Technologies, Inc.

Preparation of Pigment Dispersion Liquid for Ink Composition 40 parts by mass of a water soluble resin (one obtained by copolymerizing methacrylic acid/butyl acrylate/styrene/hydroxyethyl acrylate at a mass ratio of 25/50/15/10, Weight average molecular weight of 12,000) was put in a liquid in which 7 parts by mass of potassium hydroxide, 23 parts by mass of water, and 30 parts by mass of triethylene glycol-mono-n-butyl ether were mixed, and then heated under stirring at 80° C. to thereby prepare a aqueous resin solution.

3.0 kg of a coloring material and 10.25 kg of water were individually compounded in 1.75 kg of the aqueous resin solution (Solid content of 43%), and then stirred with a mixing stirrer for pre-mixing to thereby obtain a mixed liquid. The mixed liquid was dispersed by a multi-pass system using a horizontal bead mill having an effective volume of 1.5 liters and charged with 0.5 mm zirconia beads in a proportion of 85% and having a multi-disk impeller. Specifically, two passes were performed at a bead peripheral speed of 8 m/second and a discharge amount of 30 liters per hour, thereby obtaining a pigment dispersion mixed liquid with an average particle diameter of 325 nm. Next, circulation dispersion of the pigment dispersion mixed liquid was performed using a horizontal annular type bead mill having an effective volume of 1.5 liters and charged with 0.05 mm zirconia beads in a proportion of 95%. The dispersion treatment of 10 kg of the pigment dispersion mixed liquid was performed using a 0.015 mm screen at a bead peripheral speed of 10 m/second and a circulation amount of 300 liters/hour for 4 hours, thereby obtaining an aqueous pigment dispersion liquid with 20% coloring material solid content and 5% water soluble resin.

Preparation of Ink Composition

The pigment dispersion liquid prepared above was prepared in such a manner that the amount of the coloring material was 2.5% by mass. To the pigment dispersion liquid, each component other than the coloring material shown in Table 1 (shown below) was added to give a content (unit: % by mass) indicated in Table 1 to prepare inorganic pigment containing ink compositions (Bk, W) and non-inorganic pigment containing ink compositions (C, M, Y). Each ink composition was prepared by placing each component into a vessel, stirring and mixing them with a magnetic stirrer for 2 hours, and then filtering the mixture with a membrane filter with a pore size of 5 μm to remove foreign substances (impurities), such as wastes and coarse particles. The water-soluble resin of an amount equivalent to ¼ of the content of each coloring material was added to ink.

TABLE 1

| Material type | Material name | Bk | C | M | Y | W |
|---|---|---|---|---|---|---|
| Pigment | Carbon black | 2.5 | — | — | — | — |
| | PB15:3 | — | 2.5 | — | — | — |
| | PR122 | — | — | 2.5 | — | — |
| | PY155 | — | — | — | 2.5 | — |
| | Titanium dioxide | — | — | — | — | 10 |
| Organic solvent | 1,2-hexanediol | 5 | 5 | 5 | 5 | 5 |
| | 2-pyrrolidone | 15 | 15 | 15 | 15 | 15 |
| | Propylene glycol | 10 | 10 | 10 | 10 | 10 |
| Resin | Resin emulsion | 1 | 1 | 1 | 1 | 1 |
| | Polyethylene wax emulsion | 0.5 | 0.5 | 0.5 | 0.5 | 0.5 |
| Surfactant | Silicon surfactant | 0.5 | 0.5 | 0.5 | 0.5 | 0.5 |
| Antifoaming agent | Acetylene glycol antifoaming gent | 0.2 | 0.2 | 0.2 | 0.2 | 0.2 |
| pH adjuster | Triethanolamine | 0.2 | 0.2 | 0.2 | 0.2 | 0.2 |
| Water | Pure water | Balance | Balance | Balance | Balance | Balance |
| Total | | 100 | 100 | 100 | 100 | 100 |

Cleaning Liquid

Main materials of a cleaning liquid are as follows. Penetrant of cleaning liquid Acetylene glycol surfactant (Product name: Olfine E1010, manufactured by a Nisshin Chemical Co., Ltd.)

Humectant

Polyethylene glycol (Weight average molecular weight of 200)

Preparation of Cleaning Liquid

Each component shown in Table 2 (shown below) was added to give a content (unit: % by mass) indicated in Table 2 to thereby prepare a cleaning liquid. The cleaning liquid was prepared by placing each component into a vessel, stirring and mixing them with a magnetic stirrer for 2 hours, and then filtering the mixture with a membrane filter with a pore size of 5 μm to remove impurities, such as wastes and coarse particles.

TABLE 2

| Material type | Material name | Content (% by mass) |
|---|---|---|
| Penetrant | Acetylene glycol surfactant | 10 |
| Humectant | Polyethylene glycol (Weight average molecular weight of 200) | 90 |

Ink Jet Recording Apparatus

As an ink jet recording apparatus, one obtained by modifying Printer PX-H10000 (manufactured by Seiko Epson Corporation) (hereinafter referred to as a "PX-H10000 modified machine") was used. The modified portions were a nozzle plate, a head, an absorption member (wiping member), a driving mechanism (wiper unit driving mechanism), and the like.

Nozzle Plate

As the nozzle plate, one formed with single crystal silicon was used. With respect to the nozzle plate, a silicon oxide film ($SiO_2$ film) formed by a chemical vapor deposition (CVD) method by introducing $SiC_{14}$ and vapor into a CVD reactor. The film thickness of the $SiO_2$ film was 50 nm. Furthermore, oxygen plasma treatment was performed, and then the chemical vapor deposition method (CVD) was performed using $C_8F_{17}C_2H_4SiC_{13}$ to form a liquid repellent film (10 nm in thickness) on the $SiO_2$ film to thereby produce a silicon nozzle plate with the liquid repellent film.

As the absorption member, cupra (Density of 0.01 g/cm$^2$, Cloth thickness of 0.4 mm) which is a nonwoven fabric was used. As the elastic member, a roller with a Shore A hardness of 30 was used. The measurement of the Shore A hardness was performed by producing a sheet-shaped sample by press molding of the outer layer of a roller which was foam molded or a thermoplastic elastomer before foam molding at a temperature of 200° C., and then measuring the sheet-shaped sample according to the measurement method specified in ATSM D-2240. The content of the cleaning liquid in each experimental example was 40% by mass based on 100% by mass of the absorption member.

The wiper unit driving mechanism was a mechanism of pressing the absorption member with a predetermined load through a pressing member from a side opposite to the side contacting the nozzle plate of the recording head to bring the same into contact with an ink formation surface, and then relatively moving the absorption member and the recording head to thereby perform cleaning operation of removing the ink composition adhering to the nozzle plate by the absorption member.

Experimental Examples 1 to 4

Liquid Repellent Film Storageability Test

Recording was performed using the ink composition Bk, C, M, Y, or W shown in Table 1 using the PX-H10000 modified machine, suction operation of sucking the ink in the head using a suction pump was performed, and then the cleaning operation (wiping) was carried out as shown in Table 3. This cycle was defined as 1 time, and the cycle was repeated 100 times. The cleaning operation was performed along the nozzle arrangement direction in each nozzle array. Then, the influence on the liquid repellent film of each ink composition was evaluated. More specifically, the wiping direction is different from the direction of the embodiments in aspects of the invention (direction illustrated in FIG. 3C) and the wiping was performed in a direction in which each of discharge ports of a plurality of nozzles which discharge the inorganic pigment containing ink composition and each of discharge ports of a plurality of nozzles which discharge the non-inorganic pigment containing ink composition were continuously wiped.

TABLE 3

| | Experimental Example 1 | Experimental Example 2 | Experimental Example 3 | Experimental Example 4 |
|---|---|---|---|---|
| Wiping load (g/f) | 300 | 450 | 300 | 300 |
| Wiping speed (cm/s) | 5 | 5 | 10 | 5 |
| Impregnated liquid | Used | Used | Used | Non-used |
| Wiping member | Cloth | Cloth | Cloth | Cloth |

Thereafter, the state of the liquid repellent film near the nozzles was evaluated with an optical microscope (High-precision non-contact depth measuring machine "HISOMET II" DH2 of Union Optical Co., Ltd.), and the results of Table 4 (shown below) were obtained.

The evaluation criteria were as follows.

A: Level in which the separation of the liquid repellent film was not able to be substantially observed.

B: Level in which the liquid repellent film was slightly separated and discolored but the discharge was not influenced.

C: Level in which the liquid repellent film of the nozzle edge was separated and the discharge was influenced.

D: Level in which the liquid repellent film of the entire nozzle surface was separated and the discharge was considerably influenced.

TABLE 4

| Ink composition | Experimental Example 1 | Experimental Example 2 | Experimental Example 3 | Experimental Example 4 |
|---|---|---|---|---|
| Bk | B | C | C | C |
| C | A | A | A | A |
| M | A | A | A | A |
| Y | A | A | A | A |
| W | B | C | C | C |

Table 4 shows that the discharge ports of the plurality of nozzles which discharge the non-inorganic pigment containing ink composition were free from damages to the liquid repellent film irrespective of the load and the speed of the wiping and the presence and absence of the cleaning liquid to the wiping member and, on the other hand, damages to the liquid repellent film was serious when the load and the speed of the wiping were higher and when there were no effects of the cleaning liquid in the discharge ports of the plurality of nozzles which discharge the inorganic pigment containing ink composition.

From the results above, it can be confirmed that the inorganic pigment present between the wiping member and the surface of the nozzle plate acts on the surface of the nozzle plate to damage the liquid repellent film and the like in the wiping, and the effects of the invention which suppresses the generation of the state can be confirmed.

What is claimed is:

1. An ink jet recording apparatus, comprising:

a first discharge port array in which discharge ports of a plurality of nozzles which discharge an ink composition containing an inorganic pigment are disposed side by side;

a second discharge port array in which discharge ports of a plurality of nozzles which discharge an ink composition containing a coloring material other than the inorganic pigment are disposed side by side;

a nozzle plate having the first discharge port array and the second discharge port array;

a liquid repellent film provided on the nozzle plate;

a wiping member which wipes the surface of the nozzle plate and have absorbability of the ink composition; and a moving mechanism which varies a relative position of the nozzle plate and the wiping member, in a series of operations in which a surface of the nozzle plate is wiped by the wiping member, the second discharge port array being wiped in priority to the first discharge port array.

2. The ink jet recording apparatus according to claim 1, wherein the moving mechanism varies the relative position of the nozzle plate and the wiping member in such a manner that the second discharge port array is wiped in priority to the first discharge port array.

3. The ink jet recording apparatus according to claim 1, wherein the relative position of the nozzle plate and the wiping member varies in a single direction, and the first discharge port array and the second discharge port array are disposed on the nozzle plate in such a manner that the second discharge port array is wiped in priority to the first discharge port array.

4. The ink jet recording apparatus according claim 1, wherein the second discharge port array is wiped first.

5. The ink jet recording apparatus according claim 1, wherein, in a case where when a number of the first discharge port arrays is set to n and a number of the second discharge port arrays is set to m and when n+m is even, k=(n+m)/2 is established and when n+m is odd, k=(n+m−1)/2 is established, in a series of operations in which the wiping member wipes the surface of the nozzle plate in such a manner as to wipe the first discharge port arrays or the second discharge port arrays from the first array to the n+m-th array, a percentage in which the second discharge port arrays are wiped in a range of the first array to the k-th array is larger than a percentage in which the second discharge port arrays are wiped in a range of the k+1-th array to the n+m-th array.

6. The ink jet recording apparatus according to claim 1, wherein an average particle diameter of the inorganic pigment is 20 nm or more and 200 nm or less.

7. The ink jet recording apparatus according to claim 1, wherein a needle shape ratio (Maximum length/Minimum width of the particle) of the inorganic pigment is 1.5 or more and 3.0 or less.

8. The ink jet recording apparatus according to claim 1, wherein a content concentration of the inorganic pigment is 1.0% by weight or more in the ink composition containing the inorganic pigment.

* * * * *